US010551068B2

(12) United States Patent
Kim et al.

(10) Patent No.: US 10,551,068 B2
(45) Date of Patent: Feb. 4, 2020

(54) OVEN

(71) Applicant: SAMSUNG ELECTRONICS CO., LTD., Suwon-si, Gyeonggi-do (KR)

(72) Inventors: Kyoung Mok Kim, Yongin-si (KR); Yu Jeong Oh, Suwon-si (KR); Jung Soo Lim, Hwaseong-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 205 days.

(21) Appl. No.: 15/698,158

(22) Filed: Sep. 7, 2017

(65) Prior Publication Data

US 2018/0073741 A1 Mar. 15, 2018

(30) Foreign Application Priority Data

Sep. 9, 2016 (KR) ..... 10-2016-0116435

(51) Int. Cl.

| | |
|---|---|
| ***F24C 15/00*** | (2006.01) |
| ***F24C 7/08*** | (2006.01) |
| ***F24C 15/16*** | (2006.01) |
| ***F24C 15/20*** | (2006.01) |
| *F24C 15/02* | (2006.01) |

(52) U.S. Cl.

CPC ..... *F24C 15/002* (2013.01); *F24C 7/082* (2013.01); *F24C 15/005* (2013.01); *F24C 15/16* (2013.01); *F24C 15/20* (2013.01); *F24C 15/02* (2013.01)

(58) Field of Classification Search

CPC ..... F24C 15/002

USPC ..... 126/19 R

See application file for complete search history.

(56) References Cited

U.S. PATENT DOCUMENTS

| | | | | |
|---|---|---|---|---|
| 3,624,741 | A * | 11/1971 | Dills | F24C 15/005 126/19 R |
| 3,783,853 | A * | 1/1974 | Dills | F24C 15/005 126/19 R |
| 4,354,084 | A * | 10/1982 | Husslein | F24C 15/006 126/21 A |
| 5,235,962 | A * | 8/1993 | Doty | F24C 15/006 126/198 |
| 2003/0140917 | A1* | 7/2003 | Rummel | F24C 15/322 126/21 A |
| 2010/0282731 | A1* | 11/2010 | Jeong | F24C 15/325 219/400 |

FOREIGN PATENT DOCUMENTS

| | | |
|---|---|---|
| JP | 11-294776 | 10/1999 |
| JP | 2004-053212 | 2/2004 |

(Continued)

OTHER PUBLICATIONS

International Search Report dated Dec. 27, 2017, in corresponding International Patent Application No. PCT/KR2017/009869, 3 pgs.

(Continued)

*Primary Examiner* — Avinash A Savani

(74) *Attorney, Agent, or Firm* — Staas & Halsey LLP

(57) ABSTRACT

An oven of which cleanliness is easy to maintain. The oven includes a main body, a cooking chamber provided inside the main body and having an open front surface, a door rotatably installed on the main body to open or close the cooking chamber, and a contaminant collection layer formed on a part of an inner surface of the cooking chamber.

20 Claims, 19 Drawing Sheets

(56) References Cited

FOREIGN PATENT DOCUMENTS

| | | | |
|---|---|---|---|
| JP | 2004-333109 | | 11/2004 |
| JP | 2010-063526 | | 3/2010 |
| JP | 2010-227477 | | 10/2010 |
| JP | 2011-52861 | | 3/2011 |
| JP | 2012-237509 | | 12/2012 |
| KR | 10-2008-0032707 | | 4/2008 |
| KR | 20-2009-0003022 | | 3/2009 |
| KR | 10-2009-0059294 | | 6/2009 |
| KR | 10-2010-0009858 | | 1/2010 |
| KR | 10-2011-0007005 | | 1/2011 |
| KR | 10-2016-0027678 | | 3/2016 |
| WO | 2011/007991 | A2 | 1/2011 |
| WO | 2011/007991 | A3 | 1/2011 |

OTHER PUBLICATIONS

Extended European Search Report dated Feb. 5, 2018, in corresponding European Patent Application No. 17189687.1, 9 pgs.

* cited by examiner

FIG. 15

| SURFACE ENERGY DIFFERENCE ($mJ/m_2$) | DEGREE OF CONTAMINATION OF FIRST COATING PORTION (%) | DEGREE OF CONTAMINATION OF SECOND COATING PORTION (%) |
|---|---|---|
| 0 | 67.3 | 22.7 |
| 20 | 39.3 | 60.7 |
| 38 | 25.6 | 74.4 |
| 60 | 9.9 | 90.1 |

FIG. 17

| SURFACE ENERGY DIFFERENCE ($mJ/m_2$) | DEGREE OF CONTAMINATION OF FIRST COATING PORTION (%) | DEGREE OF CONTAMINATION OF SECOND COATING PORTION (%) |
|---|---|---|
| 0 | 67.3 | 22.7 |
| 20 | 30.5 | 69.5 |
| 38 | 18.2 | 81.8 |
| 60 | 6.6 | 93.4 |

OVEN

CROSS-REFERENCE TO RELATED APPLICATION

This application claims the benefit of Korean Patent Application No. 10-2016-0116435, filed on Sep. 9, 2016 in the Korean Intellectual Property Office, the disclosure of which is incorporated herein by reference.

BACKGROUND

1. Field

Embodiments of the present disclosure relate to an oven, and more particularly, to an oven of which cleanliness is easy to maintain.

2. Description of the Related Art

Ovens are mechanisms for sealing and heating an ingredient for cooking, and can be generally classified into an electric oven, a gas oven, and an electronic oven depending on a heat source thereof. The electric oven uses an electric heater as a heat source, and the gas oven and a microwave oven use heat due to a gas and frictional heat of water molecules due to high frequencies as heat sources thereof, respectively.

The oven has a cooking chamber for cooking food and an electric equipment chamber for accommodating electric components. In a process of cooking food, an inside of the cooking chamber is sealed so that high-temperature heat cannot leak to the outside.

The cooking chamber may be contaminated by combustion oxides or oil mist generated while cooking food. Bacterial propagation and odor generation may occur when the cooking chamber is left in a contaminated state. Therefore, various methods for keeping the cooking chamber in a clean state have been continuously studied.

SUMMARY

Therefore, it is an aspect of the present disclosure to provide an oven having an improved structure from which contaminants that may be generated during cooking may be easily removed.

It is another aspect of the present disclosure to provide an oven having an improved structure which may improve ease of cleaning of an inside of a cooking chamber.

Additional aspects of the disclosure will be set forth in part in the description which follows and, in part, will be obvious from the description, or may be learned by practice of the disclosure.

In accordance with one aspect of the present disclosure, an oven includes: a main body; a cooking chamber provided inside the main body and having an open front surface; a door rotatably installed on the main body to open or close the cooking chamber; and a contaminant collection layer formed on a part of an inner surface of the cooking chamber to prevent contamination of the cooking chamber.

Here, the contaminant collection layer may have at least one of a hydrophilic property and a lipophilic property.

Also, the cooking chamber may include an upper surface, a lower surface, a rear surface, a right side surface, and a left side surface, and the contaminant collection layer may be formed on two or more of the upper surface, the lower surface, the rear surface, the right side surface, and the left side surface.

Also, the contaminant collection layer may be formed on a plurality of surfaces which face each other among the upper surface, the lower surface, the rear surface, the right side surface, and the left side surface.

Also, the contaminant collection layer may be formed on a plurality of connected surfaces among the upper surface, the lower surface, the rear surface, the right side surface, and the left side surface.

Also, the door may include a door inner surface facing the cooking chamber, and the contaminant collection layer may be further formed on at least a part of the door inner surface.

Also, the door may further include a door glass and a door frame that supports the door glass, and the contaminant collection layer may be formed on at least one of the door glass and the door frame.

Also, the contaminant collection layer may include at least one of a planar heating layer and a catalyst coating layer.

Also, the oven may further include a convection heater provided to heat the cooking chamber; a convection fan provided to supply heat generated by the convection heater into the cooking chamber; and a cover case coupled to the rear surface of the cooking chamber to accommodate the convection heater and the convection fan therein, wherein the contaminant collection layer may be further formed on the cover case.

In accordance with another aspect of the present disclosure, an oven includes: a main body; a cooking chamber provided inside the main body and having an open front surface; a convection heater provided to heat the cooking chamber; a convection fan provided to supply heat generated by the convection heater into the cooking chamber; and a cover case having a suction port and a discharge port and coupled to one surface of the cooking chamber to accommodate the convection heater and the convection fan therein, wherein the cooking chamber includes a discharge port opposing surface opposing the discharge port, and a contaminant collection layer is formed on the discharge port opposing surface to prevent contamination of the cooking chamber.

Here, the cooking chamber may further include an upper surface, a lower surface, a rear surface, a right side surface, and a left side surface, and the contaminant collection layer may be further formed on at least one of the upper surface, the lower surface, the rear surface, the right side surface, and the left side surface, which is connected to the discharge port opposing surface.

Also, the cooking chamber may further include an upper surface, a lower surface, a rear surface, a right side surface, and a left side surface, and the contaminant collection layer may be further formed on one of the upper surface, the lower surface, the rear surface, the right side surface, and the left side surface, which faces the discharge port opposing surface.

Also, the contaminant collection layer may be further formed on the cover case.

Also, the oven may further include a door rotatably installed on the main body to open or close the cooking chamber and having a door inner surface facing the cooking chamber, wherein the contaminant collection layer is further formed on at least a part of the door inner surface.

Also, the contaminant collection layer may have at least one of a hydrophilic property and a lipophilic property.

In accordance with still another aspect of the present disclosure, an oven includes: a main body; a cooking chamber provided inside the main body and having an open front surface; a door rotatably installed on the main body to open or close the cooking chamber and having a door inner surface facing the cooking chamber; a plurality of air flow passages formed along the inner surface of the cooking chamber and the door inner surface such that air circulating inside the cooking chamber flows through the plurality of air flow passages; and a contaminant collection layer formed on any one of the plurality of air flow passages to prevent contamination of the cooking chamber.

Here, the plurality of air flow passages may include a first air flow passage and a second air flow passage, which are symmetrical with each other, and the contaminant collection layer may be formed on any one of the first air flow passage and the second air flow passage.

Also, the plurality of air flow passages may further include a door adjacent portion adjacent to the door, and the contaminant collection layer may be formed on the door adjacent portion of either the first air flow passage or the second air flow passage.

Also, the contaminant collection layer may have at least one of a hydrophilic property and a lipophilic property.

Also, the contaminant collection layer may include at least one of a planar heating layer and a catalyst coating layer.

BRIEF DESCRIPTION OF THE DRAWINGS

These and/or other aspects of the disclosure will become apparent and more readily appreciated from the following description of the embodiments, taken in conjunction with the accompanying drawings of which:

FIG. 15 is a table showing a degree of contamination of each of a first coating portion and a second coating portion according to a surface energy difference between the first coating portion and the second coating portion when the contaminant collection layer according to the first embodiment is applied to an oven in accordance with one embodiment of the present disclosure;

FIG. 17 is a table showing a degree of contamination of each of a first coating portion and a second coating portion according to a surface energy difference between the first coating portion and the second coating portion when the contaminant collection layer according to the second embodiment is applied to an oven in accordance with one embodiment of the present disclosure.

DETAILED DESCRIPTION

Hereinafter, preferred embodiments of the present disclosure will be described in detail with reference to the accompanying drawings. Meanwhile, terms used in the following description such as "distal end," "rear end," "upper portion," "lower portion," "upper end," "lower end," and the like are defined on the basis of the drawings, and the shape and position of each component are not limited by these terms.

Figure 1:
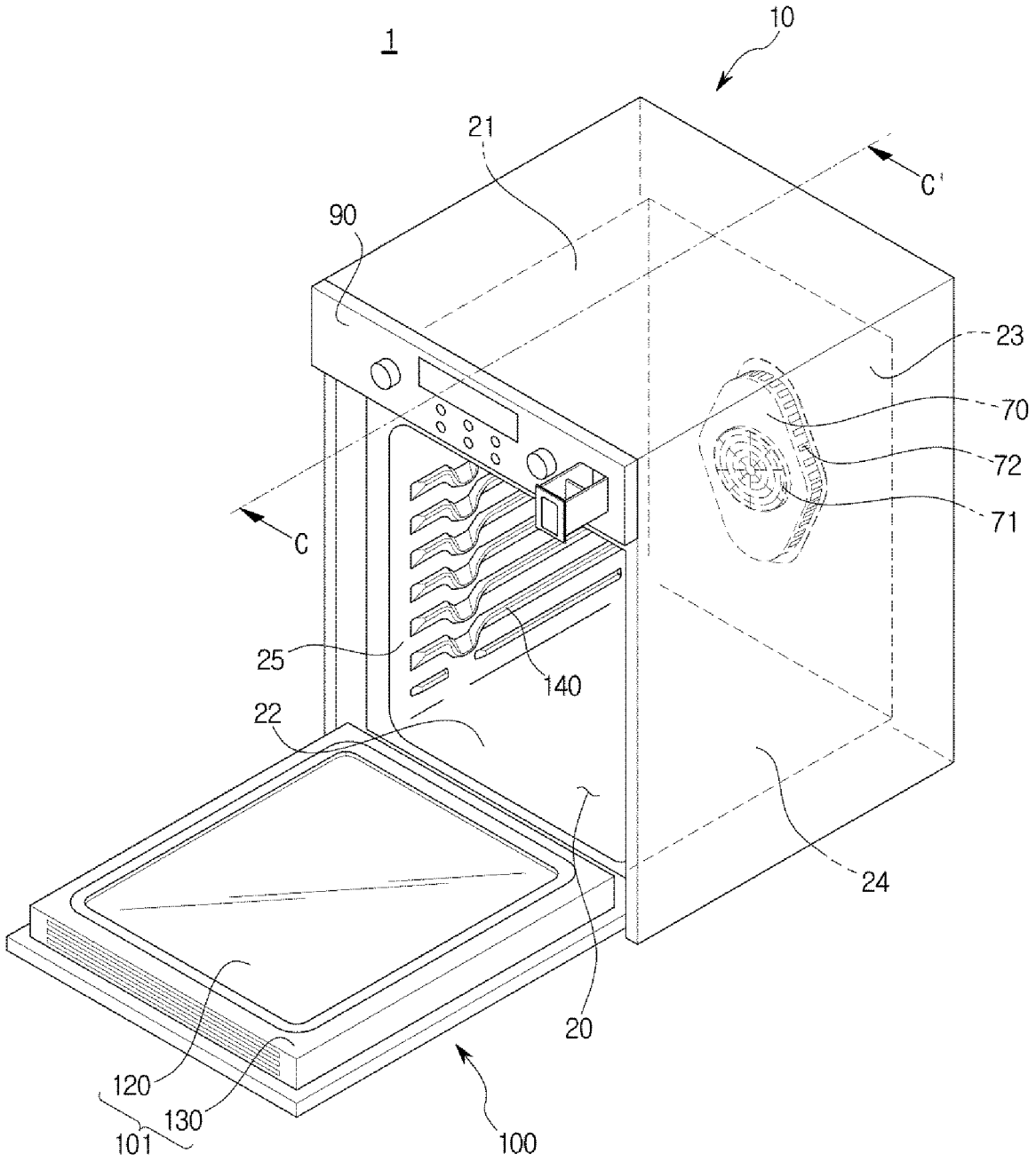
FIG. 1 is a perspective view showing an oven in accordance with one embodiment of the present disclosure.
Figure 2:
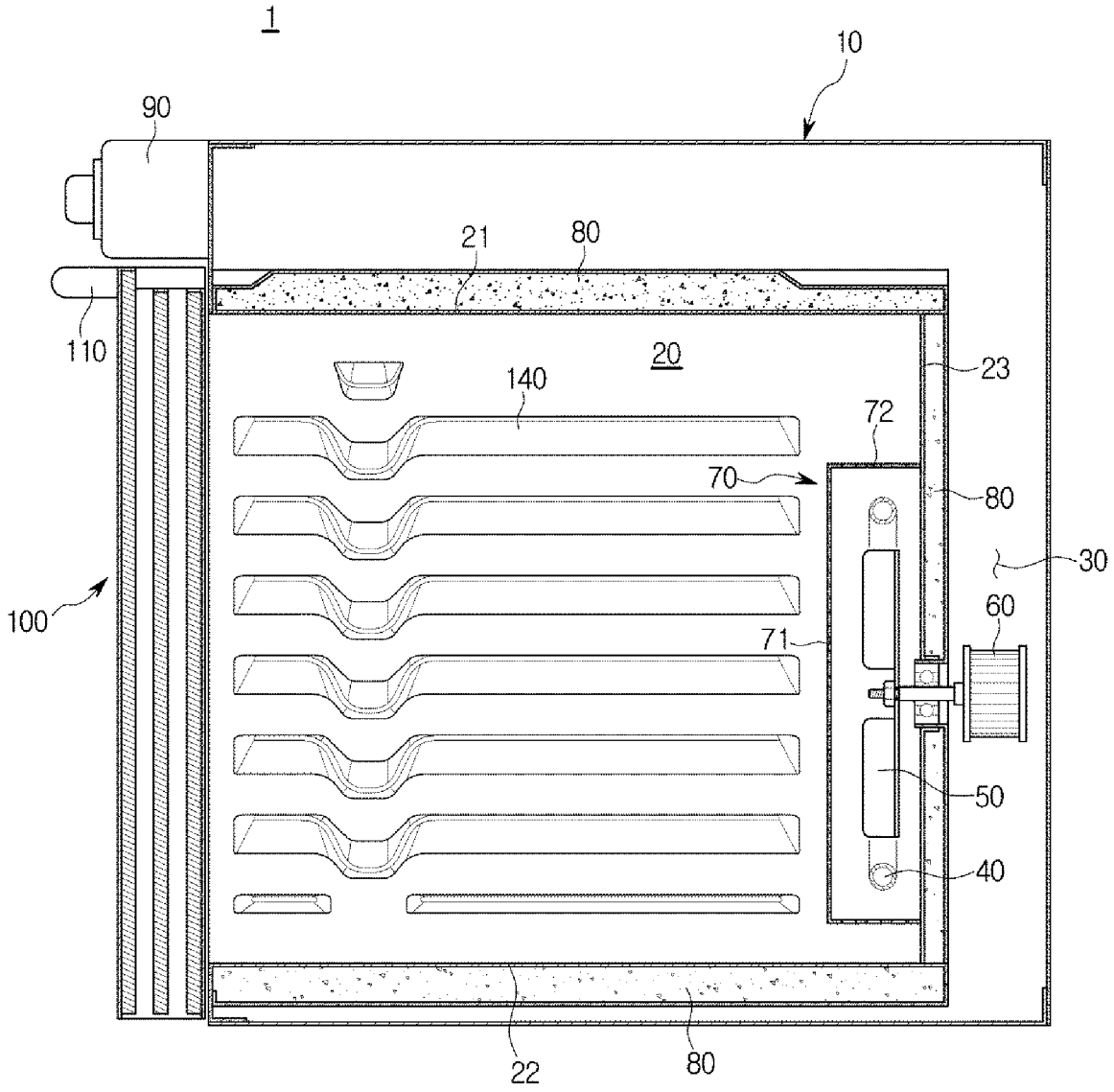
FIG. 2 is a cross-sectional view of the oven of FIG. 1 taken along line C-C'.

FIG. 1 is a perspective view showing an oven in accordance with one embodiment of the present disclosure, and FIG. 2 is a cross-sectional view of the oven of FIG. 1 taken along line C-C'.

As shown in FIGS. 1 and 2, an oven 1 may include a main body 10. The main body 10 may form an appearance of the oven 1.

The oven 1 may further include a cooking chamber 20. The cooking chamber 20 may be provided inside the main body 10. The cooking chamber 20 may have an open front surface. In other words, the front surface of the cooking chamber 20 may be opened.

The cooking chamber 20 may include an upper surface 21, a lower surface 22, a rear surface 23, a right side surface 24, and a left side surface 25.

The oven 1 may further include an electric equipment chamber 30. The electric equipment chamber 30 may be provided on a rear side of the cooking chamber 20. In other respects, the electric equipment chamber 30 may be formed in a space provided between the cooking chamber 20 and the main body 10. Electric components related to the implementation of various functions of the oven 1 may be disposed in the electric equipment chamber 30.

The oven 1 may further include a convection heater 40 provided to heat the cooking chamber 20. The convection heater 40 may be installed on the rear surface 23 of the cooking chamber 20.

The oven 1 may further include a convection fan 50 provided to supply the heat generated by the convection heater 40 into the cooking chamber 20. The convection fan 50 may be installed on the rear surface 23 of the cooking chamber 20 so that the heat generated by the convection heater 40 can be circulated inside the cooking chamber 20.

The oven 1 may further include a fan driving motor 60. The fan driving motor 60 may be connected to the convection fan 50 to transmit a driving force to the convection fan 50.

The oven 1 may further include a cover case 70. The convection heater 40 and the convection fan 50 may be accommodated inside the cover case 70. The cover case 70 may be fixed and coupled to the rear surface of the cooking chamber 20. The cover case 70 may further include a suction port 71 and a discharge port 72. The suction port 71 may be formed in a central portion of a front surface of the cover case 70 to correspond to the convection fan 50. The discharge port 72 may be formed along a side surface of the cover case 70. However, the positions of the suction port 71 and the discharge portion 72 are not limited to those described above and can be variously changed. While the oven 1 is operated, air inside the cooking chamber 20 is introduced into the cover case 70 through the suction port 71 of the cover case 70 by rotation of the convection fan 50. The air introduced into the cover case 70 is heated by the convection heater 40, and the heated air is discharged into the cooking chamber 20 through the discharge port 72 of the cover case 70. The heated air discharged into the cooking chamber 20 heats food while circulating inside the cooking chamber 20.

The oven 1 may further include a heat insulating member 80. The heat insulating member 80 may be disposed outside the cooking chamber 20 to block heat exchange between the cooking chamber 20 and the outside.

The oven 1 may further include a control panel 90. The control panel 90 may be installed in an upper portion of the main body 10 so that a user can control the operation of the oven 1.

The oven 1 may further include a door 100 rotatably installed on the main body 10 to open or close the cooking chamber 20. The door 100 may be coupled to the main body 10 to form an appearance of the front surface of the oven 1. The door 100 may be provided with a door handle 110 to facilitate opening and closing of the door 100.

The door 100 may include a door inner surface 101 facing the cooking chamber 20 and a door outer surface facing the outside. The door handle 110 may be provided on the door outer surface.

The door 100 may further include a door glass 120 and a door frame 130. The door frame 130 may be provided to support the door glass 120. One surface of the door glass 120 and one surface of the door frame 130 may form the door inner surface 101.

The oven 1 may further include a shelf (not shown). The shelf may be disposed inside the cooking chamber 20 to be drawn out of the cooking chamber so that food can be placed thereon.

The oven 1 may further include a support member 140 provided to support the shelf. The support member 140 may be formed on the right side surface 24 and the left side surface 25 of the cooking chamber 20.

The cooking chamber 20 is likely to be contaminated by combustion oxides, oil mist, or the like generated during a process of cooking food. When such combustion oxides, oil mist, and the like are left in the cooking chamber 20 for a long time, the inner surfaces of the cooking chamber 20 may be damaged. In addition, the combustion oxides may cause bacterial propagation and odor generation, which may have harmful effects on a user. Therefore, it is very important to keep the cooking chamber 20 clean. Methods of cleaning the contaminated cooking chamber 20 include pyro-cleaning and steam cleaning. Pyro-cleaning is a method of burning and removing contaminants adhered to the inner surfaces of the cooking chamber 20, and steam cleaning is a method of hydrating and removing contaminants attached to the inner surfaces of the cooking chamber 20. Although pyro-cleaning is based on the fact that removal of contaminants caused by burning is relatively easy, a long high-temperature heating time is required to burn the contaminants and a large amount of noxious gas or smoke is generated while burning the contaminants. Steam cleaning has a shorter required time when compared to pyro-cleaning and produces no noxious gas or smoke, but it has a disadvantage in that it is difficult to remove contaminants strongly adhered to the inner surfaces of the cooking chamber 20. In order to solve the problems of pyro-cleaning and steam cleaning, contaminant collection layers 300, 400, 500, 600, 700, 800, 900, 1000, 1100, 1200, 1300, and 1400 are applied to the oven 1. Detailed descriptions of the contaminant collection layers 300, 400, 500, 600, 700, 800, 900, 1000, 1100, 1200, 1300, and 1400 will be made later.

Figure 3:
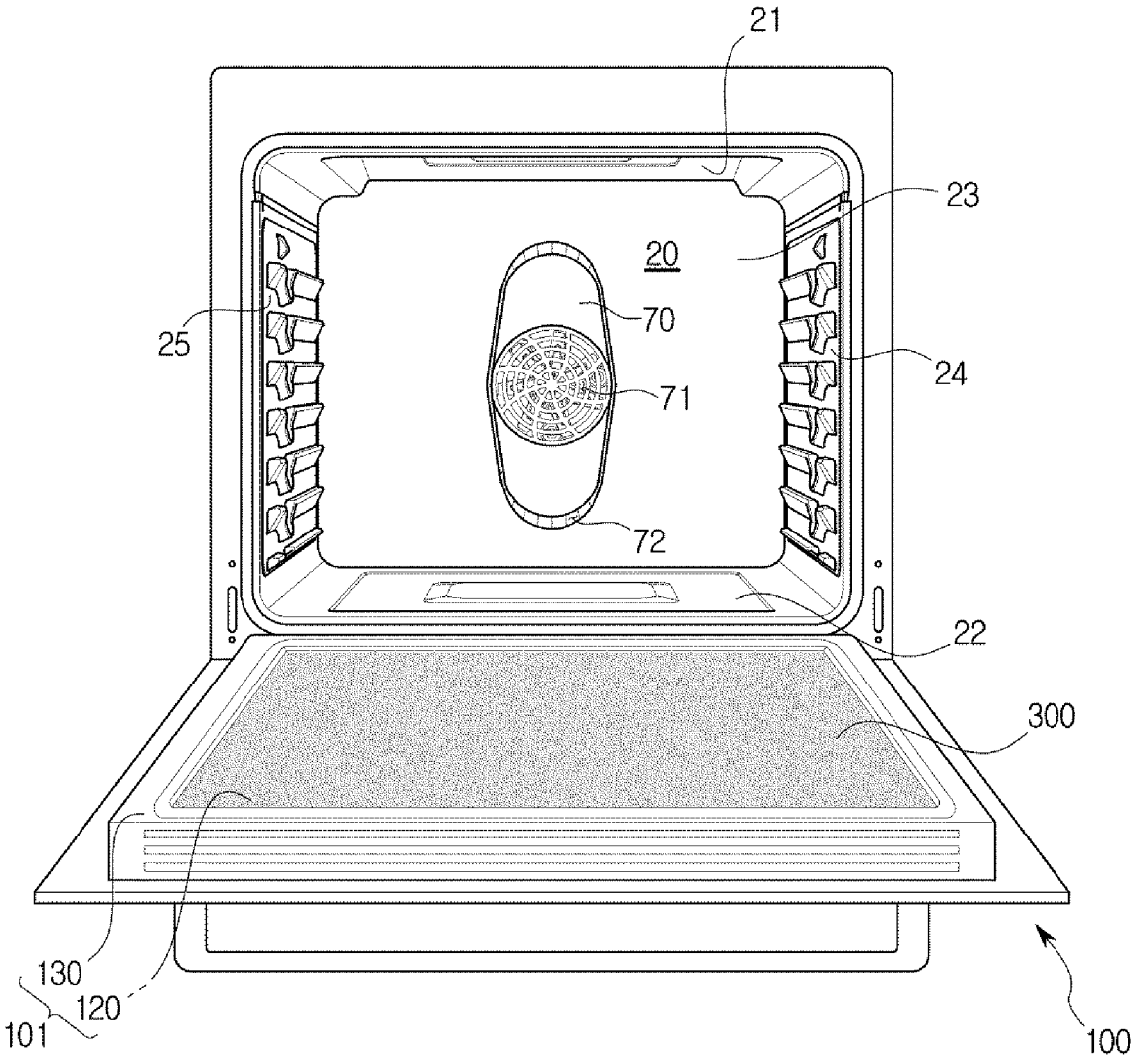
FIG. 3 is a view showing a case in which a contaminant collection layer according to a first embodiment is applied to an oven in accordance with one embodiment of the present disclosure.

FIG. 3 is a view showing a case in which a contaminant collection layer according to a first embodiment is applied to an oven in accordance with one embodiment of the present disclosure. In FIG. 3, the cooking chamber 20 and the door 100 are shown, and the door 100 is illustrated as being coupled to the cooking chamber 20 for convenience of explanation.

As shown in FIG. 3, the oven 1 may further include the contaminant collection layer 300.

The contaminant collection layer 300 may prevent contamination of the cooking chamber 20. Specifically, the contaminant collection layer 300 may keep the cooking chamber 20 clean by adsorbing contaminants generated in a cooking process. In addition, the contaminant collection layer 300 may concentrate contaminants scattered throughout the cooking chamber 20 to improve a user's cleaning convenience.

The contaminant collection layer 300 may be formed on a part of the inner surfaces of the cooking chamber 20 and the door inner surface 101. Further, the contaminant collection layer 300 may be formed in the cover case 70.

The contaminant collection layer 300 may have at least one of a hydrophilic property and a lipophilic property. As an example, the contaminant collection layer 300 may include silicon dioxide ($SiO_2$), titanium dioxide ($TiO_2$), and the like.

The contaminant collection layer 300 according to the first embodiment shown in FIG. 3 may be formed on the door inner surface 101. In other words, the contaminant collection layer 300 according to the first embodiment may be formed on at least one of the door glass 120 and the door frame 130. Preferably, the contaminant collection layer 300 according to the first embodiment may be formed on the door glass 120 of the door inner surface 101. Since the contaminant collection layer 300 has excellent adhesion with regard to contaminants, the contaminants are concentrated on the door glass 120 at which the contaminant collection layer 300 is formed. Therefore, the user can more easily remove the contaminants present in the cooking chamber 20 by cleaning only the door glass 120 instead of cleaning every corner of the cooking chamber 20.

All of the inner surfaces of the cooking chamber 20 may be coated with a material having at least one of water repellency and oil repellency so that the contaminants are more concentrated in the contaminant collection layer 300. By way of example, the material having at least one of water repellency and oil repellency may include a silane-based material and the like. The material having at least one of water repellency and oil repellency has poor adhesion with regard to contaminants so that it is relatively difficult for the contaminants to adhere to the inner surfaces of the cooking chamber 20. In addition, the remaining door inner surface 101 except for the door glass 120 may be coated with the material having at least one of water repellency and oil repellency together with all of the inner surfaces of the cooking chamber 20.

As shown in FIG. 3, when the contaminant collection layer 300 having at least one of a hydrophilic property and a lipophilic property is formed on the door glass 120, and the inner surfaces of the cooking chamber 20 and the remaining door inner surface 101 except for the door glass 120 are coated with the material having at least one of water repellency and oil repellency, an effect of reducing contaminants by about 85% is shown in comparison to a case in which all of the inner surfaces of the cooking chamber 20 and the entire door inner surface 101 are coated with the material having at least one of water repellency and oil repellency.

Figure 4:
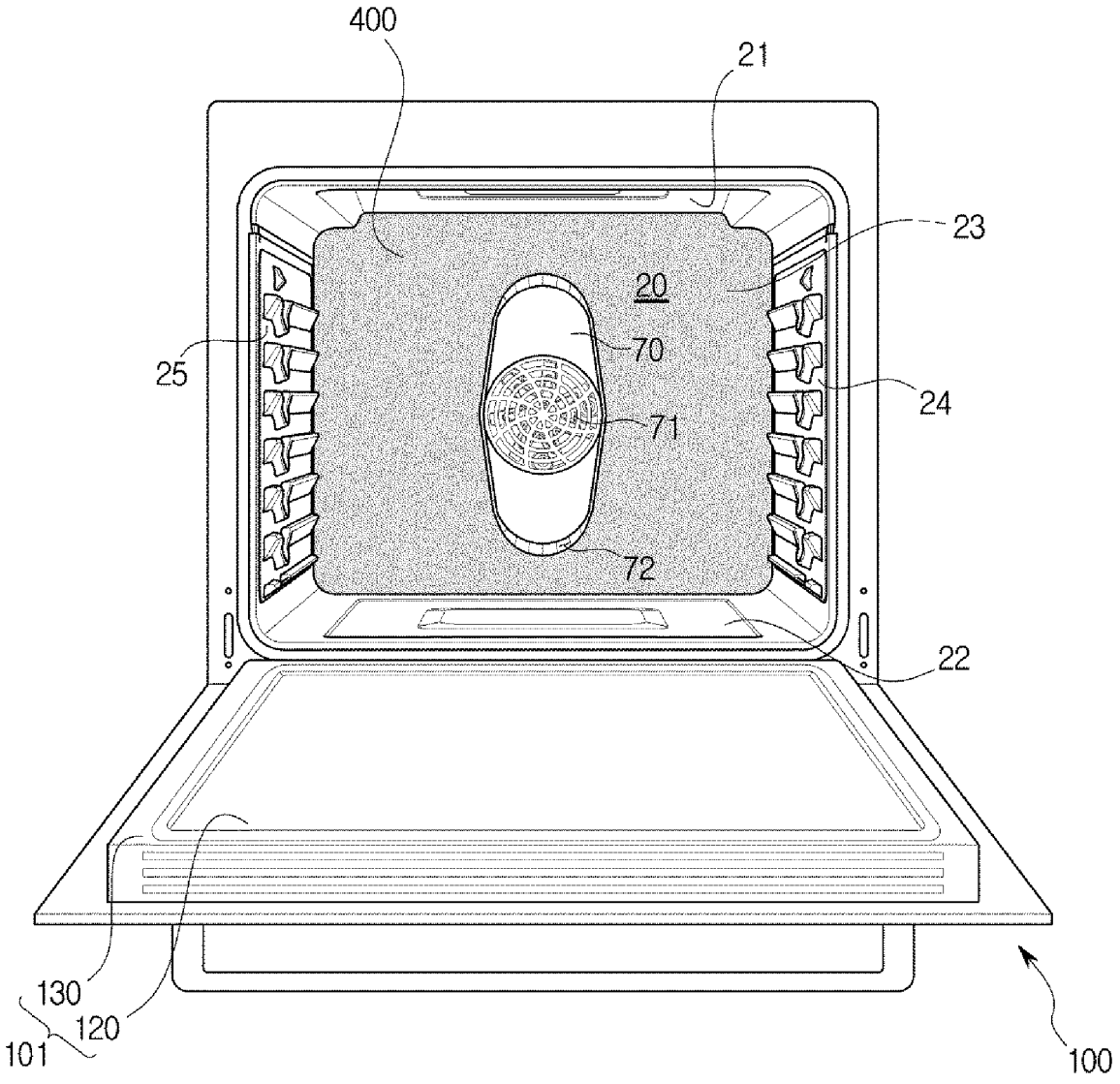
FIG. 4 is a view showing a case in which a contaminant collection layer according to a second embodiment is applied to an oven in accordance with one embodiment of the present disclosure.

FIG. 4 is a view showing a case in which a contaminant collection layer according to a second embodiment is applied to an oven in accordance with one embodiment of the present disclosure. In FIG. 4, the cooking chamber 20 and the door 100 are shown, and the door 100 is illustrated as being coupled to the cooking chamber 20 for convenience of explanation. Descriptions overlapping those of FIG. 1 will be omitted.

As shown in FIG. 4, the contaminant collection layer 400 may be formed on at least one of the inner surfaces of the cooking chamber 20. Specifically, the contaminant collection layer 400 may be formed on one of the upper surface 21, the lower surface 22, the rear surface 23, the right side surface 24, and the left side surface 25 of the cooking chamber 20.

The contaminant collection layer 400 according to the second embodiment shown in FIG. 4 may be formed on the rear surface 23 of the cooking chamber 20. Since the contaminant collection layer 400 has excellent adhesion with regard to contaminants, the contaminants are concentrated on the rear surface 23 of the cooking chamber 20 at which the contaminant collection layer 400 is formed. Therefore, a user can more easily remove the contaminants present in the cooking chamber 20 by cleaning only the rear surface 23 of the cooking chamber 20 instead of cleaning every corner of the cooking chamber 20.

The door inner surface 101 and the remaining inner surfaces of the cooking chamber 20 except for the rear surface 23 may be coated with a material having at least one of water repellency and oil repellency so that the contaminants are more concentrated in the contaminant collection layer 400.

As shown in FIG. 4, when the contaminant collection layer 400 having at least one of a hydrophilic property and a lipophilic property is formed on the rear surface 23 of the cooking chamber 20 and the door inner surface 101 and the remaining inner surfaces of the cooking chamber 20 except for the rear surface 23 are coated with the material having at least one of water repellency and oil repellency, an effect of reducing contaminants by about 90% is shown in comparison to a case in which all of the inner surfaces of the cooking chamber 20 and the entire door inner surface 101 are coated with the material having at least one of water repellency and oil repellency.

Figure 5:
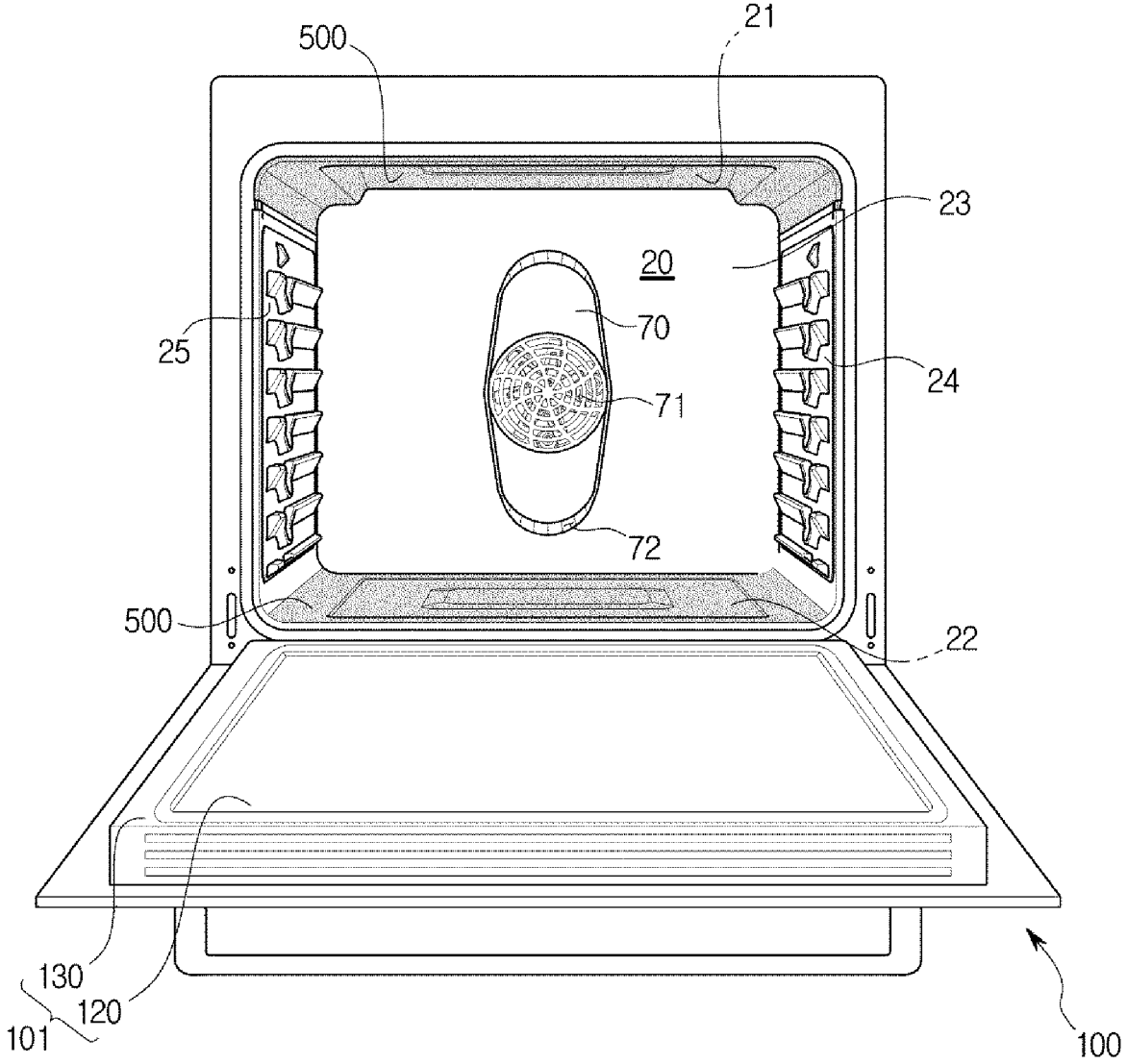
FIG. 5 is a view showing a case in which a contaminant collection layer according to a third embodiment is applied to an oven in accordance with one embodiment of the present disclosure.

FIG. 5 is a view showing a case in which a contaminant collection layer according to a third embodiment is applied to an oven in accordance with one embodiment of the present disclosure. In FIG. 5, the cooking chamber 20 and the door 100 are shown, and the door 100 is illustrated as being coupled to the cooking chamber 20 for convenience of explanation. Descriptions overlapping those of FIG. 3 will be omitted.

As shown in FIG. 5, the contaminant collection layer 500 may be formed on some of the inner surfaces of the cooking chamber 20. Specifically, the contaminant collection layer 500 may be formed on a plurality of surfaces facing each other among the upper surface 21, the lower surface 22, the rear surface 23, the right side surface 24, and the left side surface 25 of the cooking chamber 20. When the contaminant collection layer 500 is formed in this manner, an effect of concentrating contaminants at a desired portion among the inner surfaces of the cooking chamber 20 may be expected. In other words, it is relatively difficult for contaminants circulating inside the cooking chamber 20 to be adsorbed onto a portion in which the contaminant collection layer 500 is not formed. Accordingly, the contaminants may be adsorbed onto a portion in which the contaminant collection layer 500 having a relatively excellent adhesion with regard to contaminants is formed, that is, a portion that can be easily cleaned, while passing by the portion in which the contaminant collection layer 500 is not formed.

The contaminant collection layer 500 according to the third embodiment shown in FIG. 5 may be formed on the upper surface 21 and the lower surface 22 of the cooking chamber 20 which face each other. Since the contaminant collection layer 500 has excellent adhesion with regard to contaminants, the contaminants are concentrated on the upper surface 21 and the lower surface 22 of the cooking chamber 20 at which the contaminant collection layer 500 is formed. Therefore, a user can more easily keep the cooking chamber 20 clean by intensively cleaning the upper surface 21 and the lower surface 22 of the cooking chamber 20 instead of cleaning the whole cooking chamber 20.

The door inner surface 101 and the remaining inner surfaces of the cooking chamber 20 except for the upper surface 21 and the lower surface 22 may be coated with a material having at least one of water repellency and oil repellency so that the contaminants are more concentrated in the contaminant collection layer 500.

As shown in FIG. 5, when the contaminant collection layer 500 having at least one of a hydrophilic property and a lipophilic property is formed on the upper surface 21 and the lower surface 22 of the cooking chamber 20 and the entire door inner surface 101 and the remaining inner surfaces of the cooking chamber 20 except for the upper surface 21 and the lower surface 22 are coated with the material having at least one of water repellency and oil repellency, an effect of reducing contaminants by about 86% is shown in the door inner surface 101 and the remaining inner surfaces of the cooking chamber 20 except for the upper surface 21 and the lower surface 22.

Figure 6:
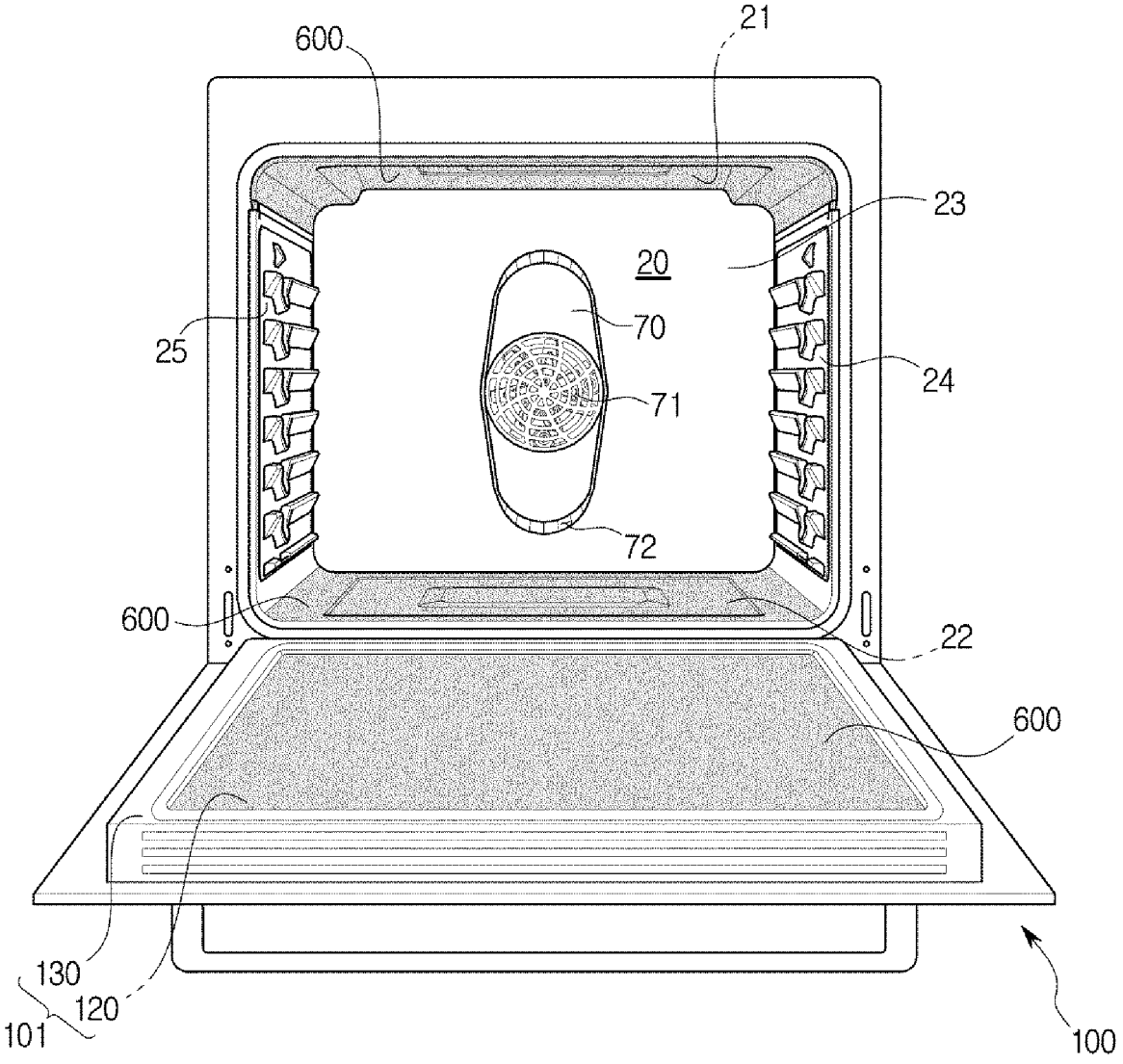
FIG. 6 is a view showing a case in which a contaminant collection layer according to a fourth embodiment is applied to an oven in accordance with one embodiment of the present disclosure.

FIG. 6 is a view showing a case in which a contaminant collection layer according to a fourth embodiment is applied to an oven in accordance with one embodiment of the present disclosure. In FIG. 6, the cooking chamber 20 and the door 100 are shown, and the door 100 is illustrated as being coupled to the cooking chamber 20 for convenience of explanation. Descriptions overlapping those of FIGS. 3 and 5 will be omitted.

As shown in FIG. 6, the contaminant collection layer 600 may be formed on some of the inner surfaces of the cooking chamber 20 and the door inner surface 101.

The contaminant collection layer 600 according to the fourth embodiment shown in FIG. 6 may be formed on the upper surface 21 and the lower surface 22 of the cooking chamber 20, which face each other, and the door inner surface 101. Specifically, the contaminant collection layer 600 may be formed on the upper surface 21 and the lower surface 22 of the cooking chamber 20, which face each other, and the door glass 120 of the door inner surface 101. Since the contaminant collection layer 600 has excellent adhesion with regard to contaminants, the contaminants are concentrated on the upper surface 21 and the lower surface 22 of the cooking chamber 20 and the door glass 120 at which the contaminant collection layer 600 is formed. Therefore, a user can more easily keep the cooking chamber 20 clean by intensively cleaning the upper surface 21 and the lower surface 22 of the cooking chamber 20 and the door glass 120 instead of cleaning the entire cooking chamber 20.

The remaining inner surfaces of the cooking chamber 20 except for the upper surface 21 and the lower surface 22 thereof and the remaining door inner surface 101 except for the door glass 120 may be coated with a material having at least one of water repellency and oil repellency so that the contaminants are more concentrated in the contaminant collection layer 600.

As shown in FIG. 6, when the contaminant collection layer 600 having at least one of a hydrophilic property and a lipophilic property is formed on the upper surface 21 and the lower surface 22 of the cooking chamber 20 and the door glass 120 and the remaining inner surfaces of the cooking chamber 20 except for the upper surface 21 and the lower surface 22 and the remaining door inner surface 101 except for the door glass 120 are coated with the material having at least one of water repellency and oil repellency, an effect of reducing contaminants by about 88% is shown in the remaining inner surfaces of the cooking chamber 20 except for the upper surface 21 and the lower surface 22.

Figure 7A:
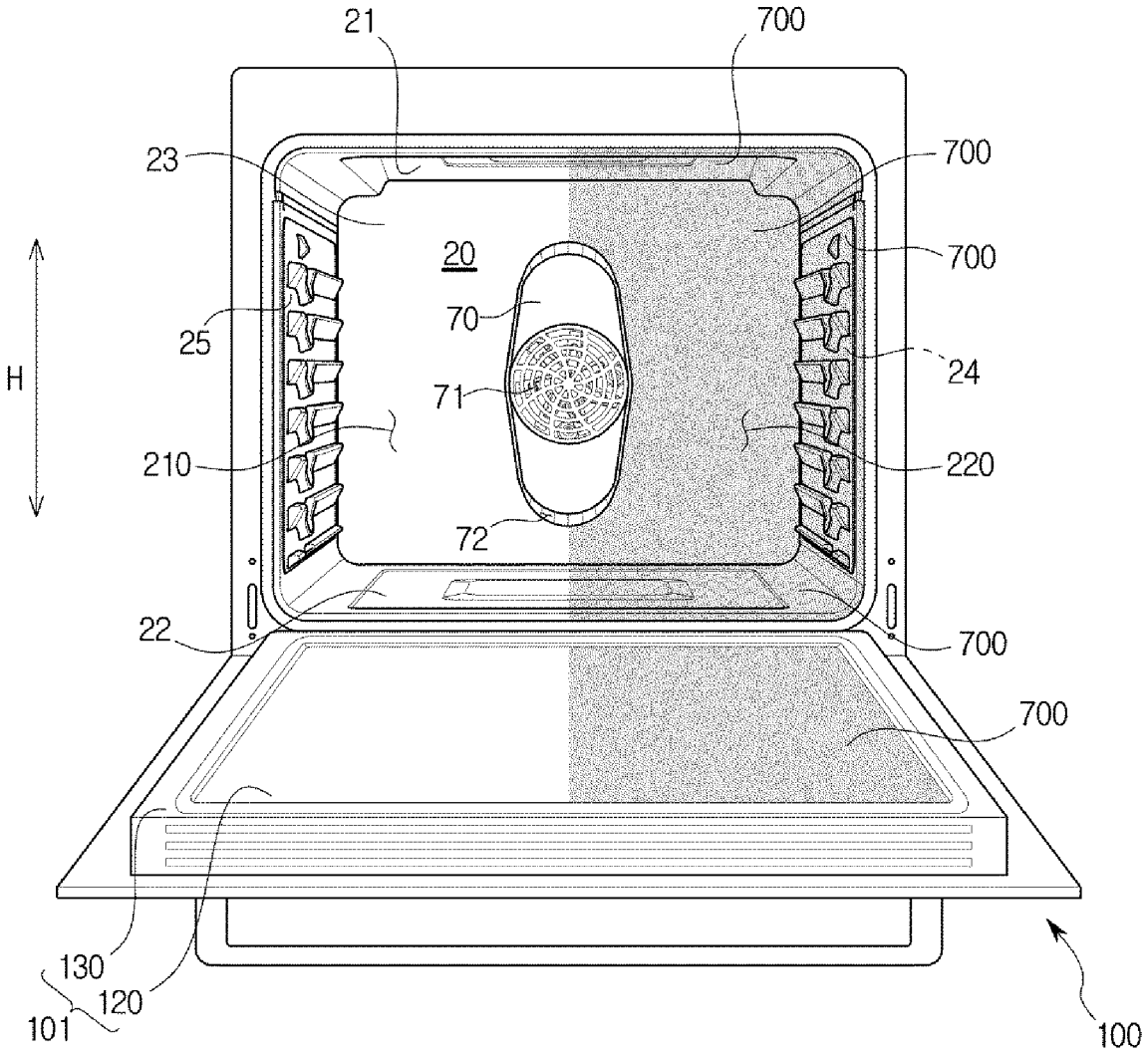
FIGS. 7A and 7B are views showing a case in which a contaminant collection layer according to a fifth embodiment is applied to an oven in accordance with one embodiment of the present disclosure.
Figure 7B:
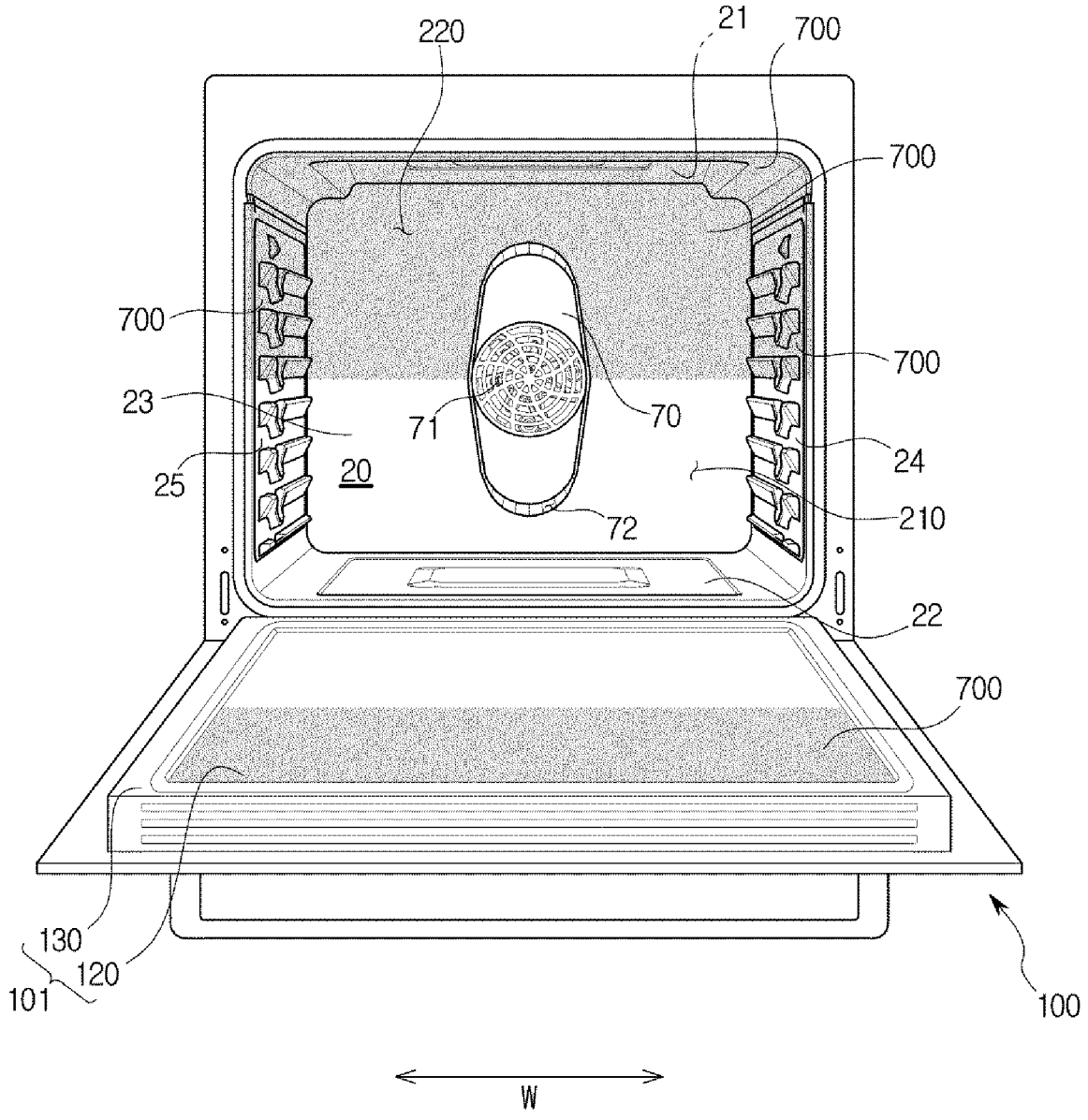

FIGS. 7A and 7B are views showing a case in which a contaminant collection layer according to a fifth embodiment is applied to an oven in accordance with one embodiment of the present disclosure. In FIGS. 7A and 7B, the cooking chamber 20 and the door 100 are shown, and the door 100 is illustrated as being coupled to the cooking chamber 20 for convenience of explanation. Descriptions overlapping those of FIGS. 3 and 5 will be omitted.

As shown in FIGS. 7A and 7B, the contaminant collection layer 700 may be formed on some of the inner surfaces of the cooking chamber 20 and a part of the door inner surface 101. Specifically, the contaminant collection layer 700 may be formed on some of a plurality of portions divided with respect to a virtual plane extending in a height direction H of the oven 1 or some of a plurality of portions divided with respect to a virtual plane extending in a width direction W of the oven 1.

The contaminant collection layer 700 according to the fifth embodiment shown in FIG. 7A may be formed on a plurality of connected surfaces among the inner surfaces of the cooking chamber 20 and a part of the door inner surface 101. Specifically, the contaminant collection layer 700 may be formed on parts of the upper surface 21, the lower surface 22, the rear surface 23, and the right side surface 24, which are connected to one another, and the door glass 120 of the door inner surface 101. More specifically, when the oven 1 is divided into a first region 210 and a second region 220 with respect to the virtual plane extending in the height direction H of the oven 1, the contaminant collection layer 700 may be formed in either the first region 210 or the second region 220. Consequently, the contaminant collection layer 700 according to the fifth embodiment shown in FIG. 7A may be formed on a part of the upper surface 21, a part of the lower surface 22, a part of the rear surface 23, and the right side surface 24 of the cooking chamber 20, and a part of the door glass 120, which correspond to either the first region 210 or the second region 220. When the contaminant collection layer 700 is formed in this manner, contaminants are concentrated in either the first region 210 or the second region 220. Therefore, a user can more easily keep the cooking chamber 20 clean by intensively cleaning either the first region 210 or the second region 220 instead of cleaning both the first region 210 and the second region 220.

The remaining portions except for portions in which the contaminant collection layer 700 is formed may be coated with a material having at least one of water repellency and oil repellency so that the contaminants are more concentrated in the contaminant collection layer 700.

When the oven 1 is divided into the first region 210 and the second region 220 with respect to a virtual plane extending in the width direction H of the oven 1, the contaminant collection layer 700 according to the fifth embodiment shown in FIG. 7B may be formed on either the first region 210 or the second region 220. Consequently, the contaminant collection layer 700 according to the fifth embodiment shown in FIG. 7B may be formed on a part of the upper surface 21, a part of the right side surface 24, a part of the left side surface 25, a part of the rear surface 23, and a part of the door glass 120 which correspond to either the first region 210 or the second region 220. An effect that can be expected when the contaminant collection layer 700 is formed as shown in FIG. 7B is the same as that described with reference to FIG. 7A, and a description thereof will be omitted.

The remaining portions except for the portions in which the contaminant collection layer 700 is formed may be coated with the material having at least one of water repellency and oil repellency so that the contaminants are more concentrated in the contaminant collection layer 700.

As shown in FIGS. 7A and 7B, when the contaminant collection layer 700 is formed, an effect of reducing contaminants by about 95% is shown in a portion coated with the material having at least one of water repellency and oil repellency.

Other aspects of, the contaminant collection layer 700 will be described below.

The oven 1 may further include a plurality of air flow passages formed along the inner surfaces of the cooking chamber 20 and the door inner surface 101 so that air circulating inside the cooking chamber 20 is moved.

The contaminant collection layer 700 may be formed in any one of the plurality of air flow passages to prevent contamination of the cooking chamber 20.

The plurality of air flow passages may include a first air flow passage 210 and a second air flow passage 220, which are symmetrical with each other. In the case of FIG. 7A, the first air flow passage 210 and the second air flow passage 220 may be symmetrical with each other with respect to a virtual plane extending in the height direction H of the oven 1. In the case of FIG. 7B, the first air flow passage 210 and the second air flow passage 220 may be symmetrical with each other with respect to a virtual plane extending in the width direction W of the oven 1.

Preferably, the contaminant collection layer 700 may be formed on the door 100 or the plurality of air flow passages adjacent to the door 100. This is because a user can easily remove the contaminants. That is, when the contaminant collection layer 700 is formed on the door 100 or the plurality of air flow passages adjacent to the door 100, the user can easily remove the contaminants by intensively cleaning the door inner surface 101 or the inner surface of the cooking chamber 20 adjacent to the door 100 such that it is possible to reduce labor of the user associated with cleaning the cooking chamber 20.

At this time, the contaminant collection layer 700 may have at least one of a hydrophilic property and a lipophilic property. In addition, the contaminant collection layer 700 may include at least one of a planar heating layer and a catalyst coating layer.

Figure 8:
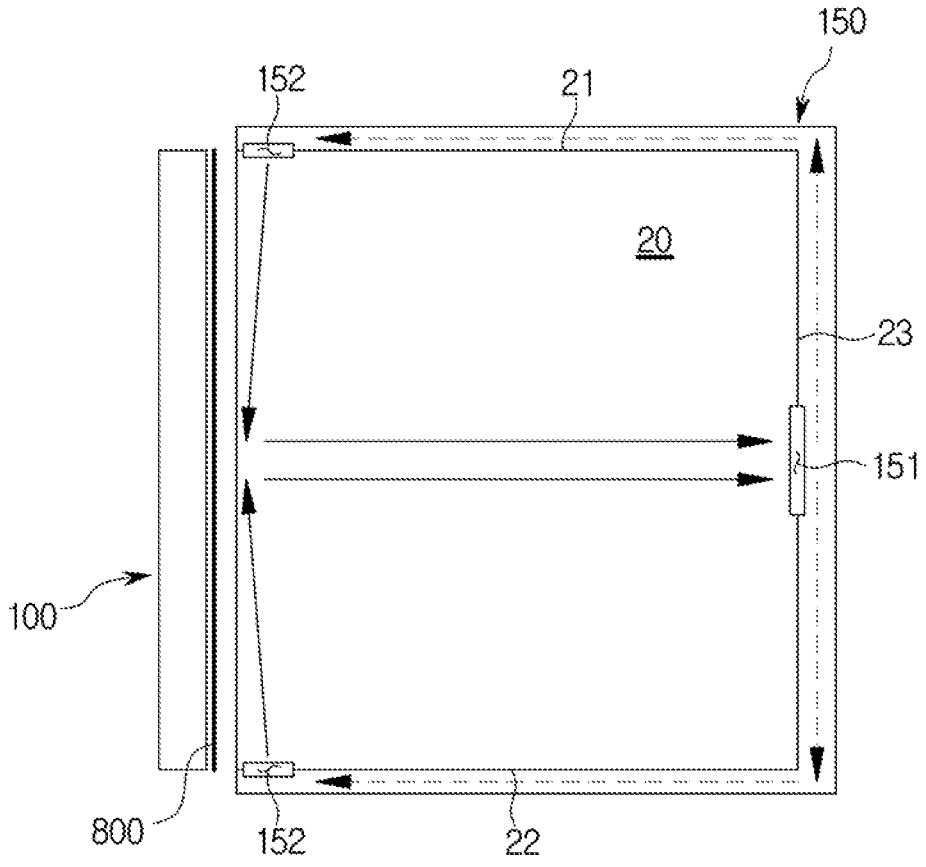
FIG. 8 is a schematic view showing a case in which a contaminant collection layer according to a sixth embodiment is applied to an oven in accordance with another embodiment of the present disclosure.

FIG. 8 is a schematic view showing a case in which a contaminant collection layer according to a sixth embodiment is applied to an oven in accordance with another embodiment of the present disclosure. FIG. 8 is a view schematically showing the cooking chamber 20 and the door 100, and descriptions overlapping those of FIGS. 1 to 3 will be omitted.

As shown in FIG. 8, the oven 1 may further include a duct 150 formed along an outer periphery of the cooking chamber 20.

A duct inlet 151 may be formed in the rear surface 23 of the cooking chamber 20 so that air inside the cooking chamber 20 can be introduced into the duct 150.

In addition, a duct outlet 152 may be formed in each of the upper surface 21 and the lower surface 22 of the cooking chamber 20 so that air flowing along the duct 150 can be discharged into the cooking chamber 20.

The contaminant collection layer 800 according to the sixth embodiment shown in FIG. 8 may be formed on at least a part of the door inner surface 101.

Preferably, the contaminant collection layer 800 may be formed on the door glass 120 of the door inner surface 101.

The air inside the cooking chamber 20 is introduced into the duct 150 through the duct inlet 151, and the air flowing along the duct 150 is discharged into the cooking chamber 20 through the duct outlet 152. The air inside the duct 150 may collide with the door inner surface 101 while the air is discharged into the cooking chamber 20 through the duct outlet 152. Accordingly, as in the contaminant collection layer 800 according to the sixth embodiment shown in FIG. 8, when the contaminant collection layer 800 is formed on at least a part of the door inner surface 101, contaminants in the air can be collected more effectively.

All of the inner surfaces of the cooking chamber 20 may be coated with a material having at least one of water repellency and oil repellency so that the contaminants are more concentrated in the contaminant collection layer 800.

As shown in FIG. 8, when the contaminant collection layer 800 having at least one of a hydrophilic property and a lipophilic property is formed on the door glass 120 and the inner surfaces of the cooking chamber 20 and the remaining door inner surface 101 except for the door glass 120 are coated with the material having at least one of water repellency and oil repellency, an effect of reducing contaminant by about 98% is shown in comparison to a case in which all of the inner surfaces of the cooking chamber 20 and the entire door inner surface 101 are coated with the material having at least one of water repellency and oil repellency.

Figure 9:
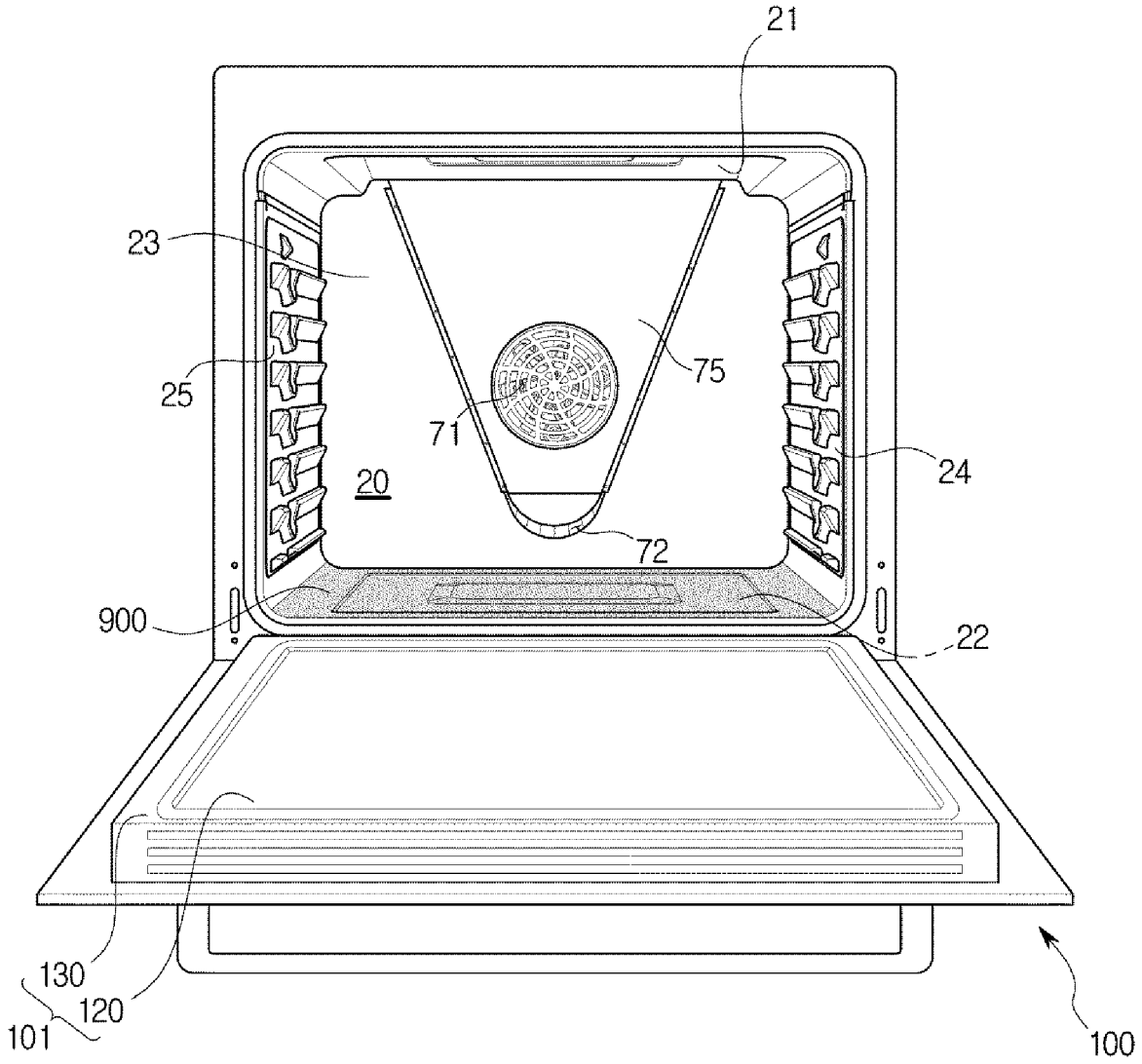
FIG. 9 is a view showing a case in which a contaminant collection layer according to a seventh embodiment is applied to an oven in accordance with still another embodiment of the present disclosure.

FIG. 9 is a view showing a case in which a contaminant collection layer according to a seventh embodiment is applied to an oven in accordance with still another embodiment of the present disclosure. In FIG. 9, the cooking chamber 20 and the door 100 are shown, and the door 100 is illustrated as being coupled to the cooking chamber 20 for convenience of explanation. Descriptions overlapping those of FIG. 3 will be omitted.

As shown in FIG. 9, a cover case 75 may include a suction port 71 and a discharge port 72 and may be coupled to one surface of the cooking chamber 20 to accommodate the convection heater 40 and the convection fan 50 therein. The suction port 71 may be formed at a central portion of a front surface of the cover case 75. The discharge port 72 may be formed on a lower surface of the cover case 75 to face the lower surface 22 of the cooking chamber 20.

The cooking chamber 20 may include a discharge port opposing surface opposing the discharge port 72 of the cover case 75. In the case of FIG. 9, the discharge port opposing surface refers to the lower surface 22 of the cooking chamber 20.

The oven 1 may further include the contaminant collection layer 900 formed on the discharge port opposing surface to prevent contamination of the cooking chamber 20. In the case of FIG. 9, the contaminant collection layer 900 may be formed on the lower surface 22 of the cooking chamber 20.

In this manner, when the contaminant collection layer 900 is formed on the discharge port opposing surface, contaminants may be absorbed onto the discharge port opposing surface before air discharged from the discharge port 72 of the cover case 75 circulates inside the cooking chamber 20, and thus it is possible to prevent contamination of the inner surfaces of the cooking chamber 20 and the door inner surface 101.

The remaining inner surfaces of the cooking chamber except for the discharge port opposing surface and the door inner surface 101 may be coated with a material having at least one of water repellency and oil repellency so that the contaminants are more concentrated in the contaminant collection layer 900.

As shown in FIG. 9, when the contaminant collection layer 900 having at least one of a hydrophilic property and a lipophilic property is formed on the lower surface 22 of the cooking chamber 20 and the remaining inner surfaces of the cooking chamber 20 except for the lower surface 22 of the cooking chamber 20 and the door inner surface 101 are coated with the material having at least one of water repellency and oil repellency, an effect of reducing contaminants by about 95% is shown in comparison to a case in which all of the inner surfaces of the cooking chamber 20 and the entire door inner surface 101 are coated with the material having at least one of water repellency and oil repellency.

Figure 10:
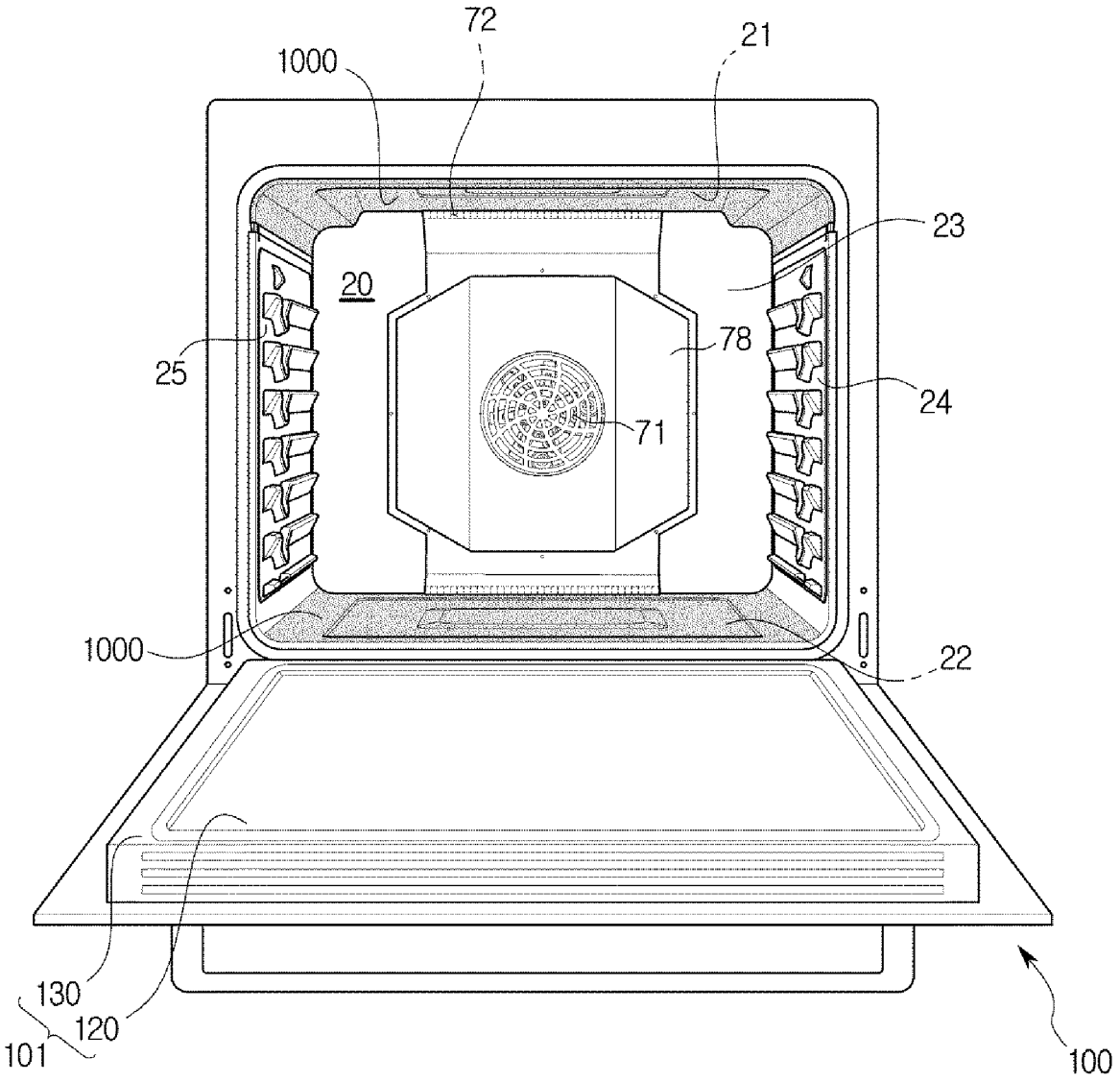
FIG. 10 is a view showing a case in which a contaminant collection layer according to an eighth embodiment is applied to an oven in accordance with yet another embodiment of the present disclosure.

FIG. 10 is a view showing a case in which a contaminant collection layer according to an eighth embodiment is applied to an oven in accordance with yet another embodiment of the present disclosure. In FIG. 10, the cooking chamber 20 and the door 100 are shown, and the door 100 is illustrated as being coupled to the cooking chamber 20 for convenience of explanation. Descriptions overlapping those of FIG. 1 will be omitted.

As shown in FIG. 10, a cover case 78 may include a suction port 71 and a discharge port 72 and may be coupled to one surface of the cooking chamber 20 to accommodate the convection heater 40 and the convection fan 50 therein. The suction port 71 may be formed at a central portion of a front surface of the cover case 78. The discharge port 72 may be formed on an upper surface and a lower surface of the cover case 78 to face the upper surface 21 and the lower surface 22 of the cooking chamber 20.

The cooking chamber 20 may include a discharge port opposing surface opposing the discharge port 72 of the cover case 78. In the case of FIG. 10, the discharge port opposing surface refers to the upper surface 21 and the lower surface 22 of the cooking chamber 20.

The oven 1 may further include the contaminant collection layer 1000 formed on the discharge port opposing surface to prevent contamination of the cooking chamber 20. In the case of FIG. 10, the contaminant collection layer 1000 may be formed on the upper surface 21 and the lower surface 22 of the cooking chamber 20.

An effect that can be expected when the contaminant collection layer 1000 is formed as shown in FIG. 10 is the same as that described with reference to FIG. 9, and a description thereof will be omitted.

The remaining inner surfaces of the cooking chamber 20 except for the discharge port opposing surface and the door inner surface 101 may be coated with a material having at least one of water repellency and oil repellency so that the contaminants are more concentrated in the contaminant collection layer 1000.

As shown in FIG. 10, when the contaminant collection layer 1000 having at least one of a hydrophilic property and a lipophilic property is formed on the upper surface 21 and the lower surface 22 of the cooking chamber 20 and the remaining inner surfaces of the cooking chamber 20 except for the upper surface 21 and the lower surface 22 of the cooking chamber 20 and the door inner surface 101 are coated with the material having at least one of water repellency and oil repellency, an effect of recusing contaminants by about 95% is shown in the remaining inner surfaces of the cooking chamber 20 except for the upper surface 21 and the lower surface 22 of the cooking chamber 20 and the door inner surface 101.

The case in which the contaminant collection layers 900 and 1000 are formed on the discharge port opposing surface has been mainly described above in FIGS. 9 and 10. However, the contaminant collection layer may be further formed on at least one of the upper surface 21, the lower surface 22, the rear surface 23, the right side surface 24, and the left side surface 25 of the cooking chamber 20, which is connected to the discharge port opposing surface. Alternatively, the contaminant collection layer may be further formed on one of the upper surface 21, the lower surface 22, the rear surface 23, the right side surface 24, and the left side surface 25 of the cooking chamber 20, which faces the discharge port opposing surface. In addition, the contaminant collection layer may be further formed on the cover case. Further, the contaminant collection layer may be further formed on at least a part of the door inner surface 101.

Figure 11:
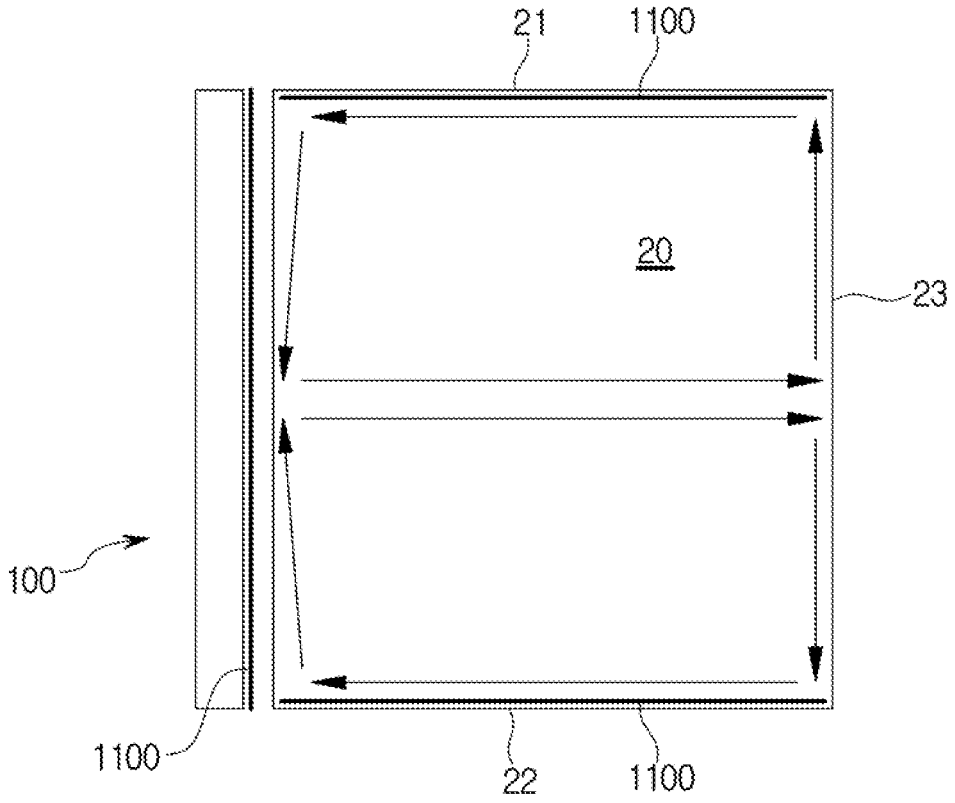
FIG. 11 is a view showing a case in which a contaminant collection layer according to a ninth embodiment is applied to an oven in accordance with a further embodiment of the present disclosure.

FIG. 11 is a view showing a case in which a contaminant collection layer according to a ninth embodiment is applied to an oven in accordance with a further embodiment of the present disclosure. FIG. 11 is a view schematically showing the cooking chamber 20 and the door 100, and descriptions overlapping those of FIGS. 1 to 3 will be omitted.

As shown in FIG. 11, the contaminant collection layer 1100 may be formed on some of the inner surfaces of the cooking chamber 20 and a part of the door inner surface 101.

The contaminant collection layer 1100 according to the ninth embodiment shown in FIG. 11 may be formed on the upper surface 21 and the lower surface 22 of the cooking chamber 20 and a part of the door inner surface 101, preferably, the door glass 120, so that an air flow inside the cooking chamber 20 may be concentrated. By changing a position of the discharge port 72 formed in the cover case, an arrangement position of the convection fan 50, an arrangement of the duct, and the like, the air flow inside the cooking chamber 20 may be concentrated on the inner surfaces of the cooking chamber 20 and a part of the door inner surface 101, and then the contaminant collection layer 1100 may be formed at the positions at which the air flow is concentrated to more easily collect contaminants.

The remaining inner surfaces of the cooking chamber 20 except for the upper surface 21 and the lower surface 22 of the cooking chamber 20 and the remaining door inner surface 101 except for the door glass 120 may be coated with a material having at least one of water repellency and oil repellency so that the contaminants are more concentrated in the contaminant collection layer 1100.

When the contaminant collection layer 1100 is formed as shown in FIG. 11, an effect of reducing contaminants by about 95% is shown in the portion coated with the material having at least one of water repellency and oil repellency.

Figure 12:
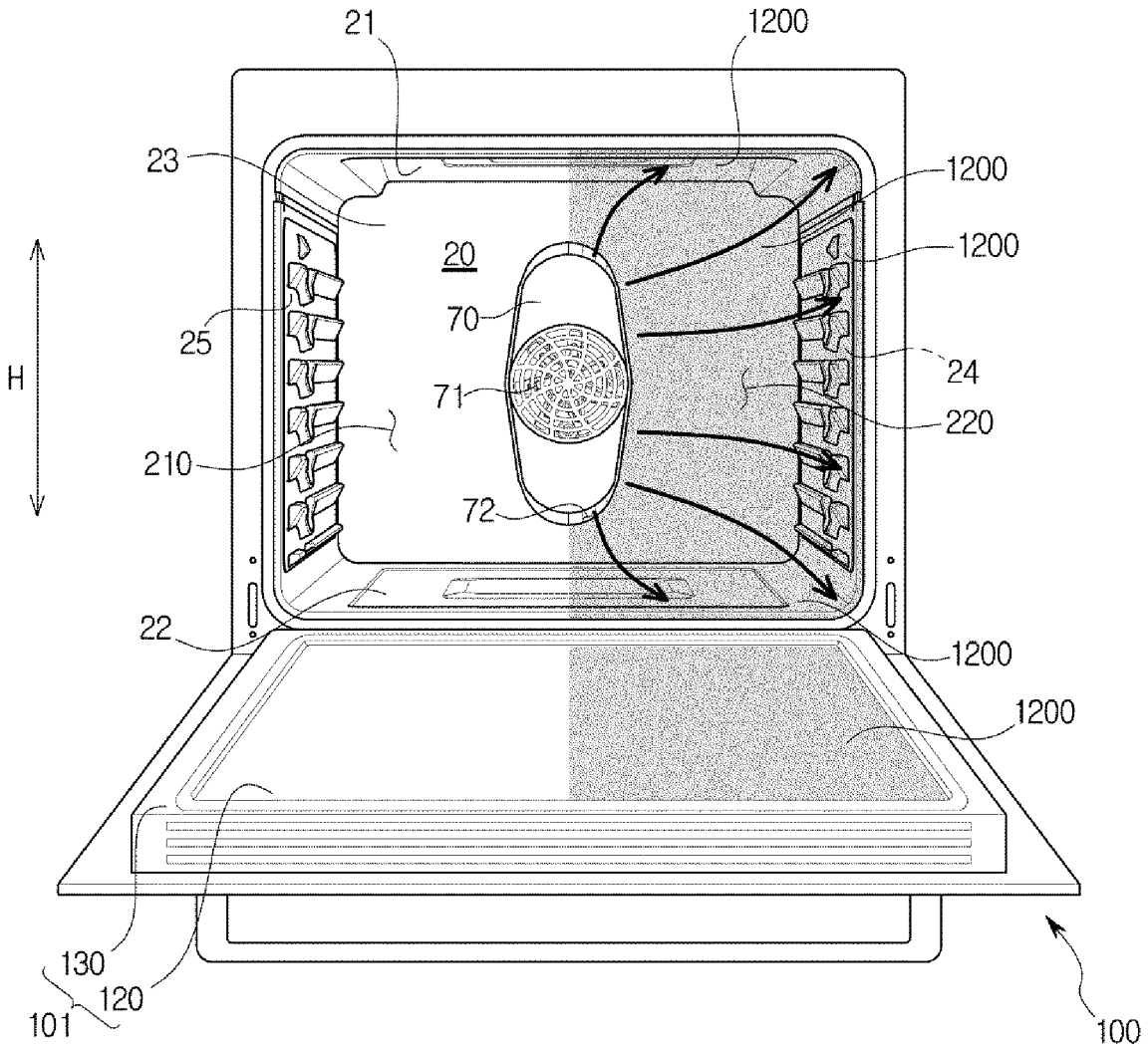
FIG. 12 is a view showing a case in which a contaminant collection layer according to a tenth embodiment is applied to an oven in accordance with a further embodiment of the present disclosure.

FIG. 12 is a view showing a case in which a contaminant collection layer according to a tenth embodiment is applied to an oven in accordance with a further embodiment of the present disclosure. In FIG. 12, the cooking chamber 20 and the door 100 are shown, and the door 100 is illustrated as being coupled to the cooking chamber 20 for convenience of explanation. Descriptions overlapping those of FIG. 3 will be omitted.

As shown in FIG. 12, the cover case 70 may include the suction port 71 and the discharge port 72 and may be coupled to one surface of the cooking chamber 20 to accommodate the convection heater 40 and the convection fan 50 therein. The suction port 71 may be formed at the central portion of the front surface of the cover case 70. When the oven 1 is divided into the first region 210 and the second region 220 with respect to a virtual plane extending in the height direction H of the oven 1, the discharge port 72 may be formed along the side surface of the cover case 70 to face either the first region 210 or the second region 220.

The cooking chamber 20 may include a discharge port opposing surface opposing the discharge port 72 of the cover case 70. In the case of FIG. 12, the discharge port opposing surface refers to a part of the upper surface 21, a part of the lower surface 22, and the right side surface 24 of the cooking chamber 20, which correspond to either the first region 210 or the second region 220.

The oven 1 may further include the contaminant collection layer 1200 formed on at least one of the discharge port opposing surface, the upper surface 21, the lower surface 22, the right side surface 24, and the left side surface 25 of the cooking chamber 20, which is connected to the discharge port opposing surface, and formed on at least a part of the door inner surface 101 so that contamination of the cooking chamber 20 is prevented. In the case of FIG. 12, the contaminant collection layer 1200 may be formed on a part of the upper surface 21, a part of the lower surface 22, a part of the rear surface 23, and the right side surface 24 of the cooking chamber 20, and a part of the door inner surface 101, preferably, a part of the door glass 120, which correspond to either the first region 210 or the second region 220.

An effect that can be expected when the contaminant collection layer 1200 is formed as shown in FIG. 12 is the same as that described with reference to FIGS. 9 and 10, and a description thereof will be omitted.

The inner surfaces of the cooking chamber 20 and the door inner surface 101 except for portions at which the contaminant collection layer 1200 is formed may be coated with a material having at least one of water repellency and oil repellency so that contaminants are more concentrated in the contaminant collection layer 1200.

When the contaminant collection layer 1200 is formed as shown in FIG. 12, an effect of reducing contaminants by about 99% is shown in the portions coated with the material having at least one of water repellency and oil repellency.

Figure 13:
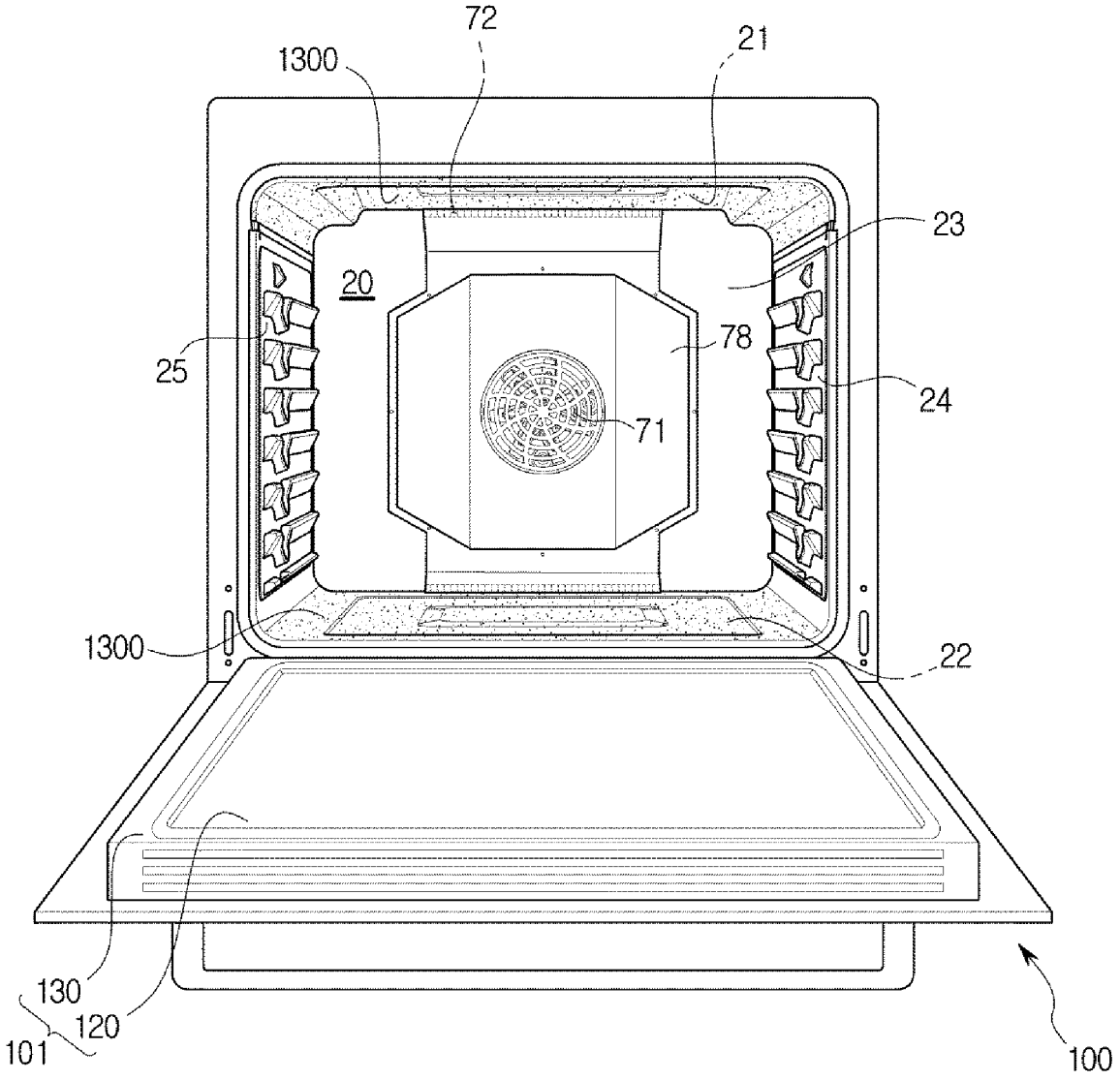
FIG. 13 is a view showing a case in which a contaminant collection layer according to an eleventh embodiment is applied to an oven in accordance with a further embodiment of the present disclosure.
Figure 14:
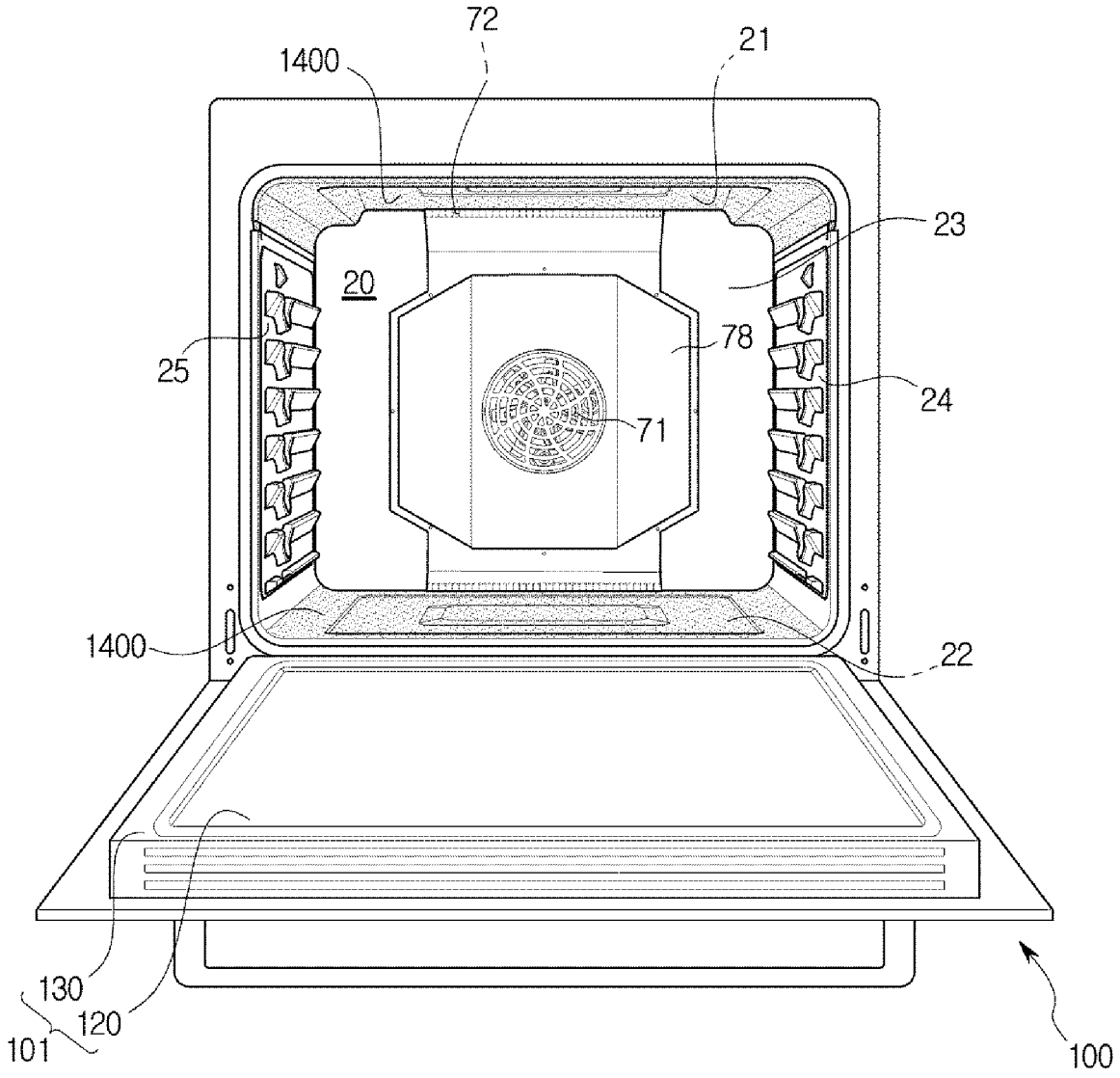
FIG. 14 is a view showing a case in which a contaminant collection layer according to a twelfth embodiment is applied to an oven in accordance with a further embodiment of the present disclosure.

FIG. 13 is a view showing a case in which a contaminant collection layer according to an eleventh embodiment is applied to an oven in accordance with a further embodiment of the present disclosure, and FIG. 14 is a view showing a case in which a contaminant collection layer according to a twelfth embodiment is applied to an oven in accordance with a further embodiment of the present disclosure. In FIGS. 13 and 14, the cooking chamber 20 and the door 100 are shown, and the door 100 is illustrated as being coupled to the cooking chamber 20 for convenience of explanation. Descriptions overlapping those of FIGS. 3 and 10 will be omitted.

As shown in FIGS. 13 and 14, the contaminant collection layers 1300 and 1400 may include at least one of a planar heating layer and a catalyst coating layer.

FIG. 13 shows a case in which the contaminant collection layer 1300 includes a planar heating layer. The contaminant collection layer 1300 according to the eleventh embodiment shown in FIG. 13 includes the planar heating layer and is formed on the upper surface 21 and the lower surface 22 of the cooking chamber 20. When the planar heating layer is operated for 50 minutes or more and 60 minutes or less, 99% or more of contaminants collected in the upper surface 21 and the lower surface 22 of the cooking chamber 20 may be removed.

FIG. 14 shows a case in which the contaminant collection layer 1400 includes a catalyst coating layer. The catalyst coating layer may include at least one of manganese dioxide ($MnO_2$), copper oxide (CuO), platinum (Pt), and lead (Pb). The contaminant collection layer 1400 according to the twelfth embodiment shown in FIG. 14 includes the catalyst coating layer and is formed on the upper surface 21 and the lower surface 22 of the cooking chamber 20.

When the contaminant collection layer simultaneously includes the planar heating layer and the catalyst coating layer, 99% or more of the contaminants collected in the upper surface 21 and the lower surface 22 of the cooking chamber 20 may be removed by operating the planar heating layer for a much short time than when the contaminant collection layer 1300 includes only the planar heating layer as shown in FIG. 13.

Figure 16:
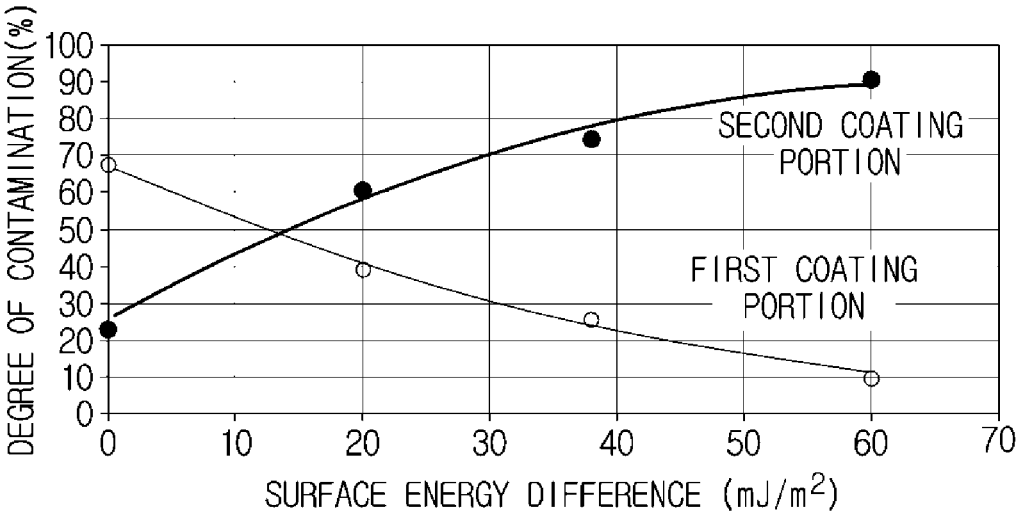
FIG. 16 is a graph showing the table of FIG. 15.

FIG. 15 is a table showing a degree of contamination of each of a first coating portion and a second coating portion according to a surface energy difference between the first coating portion and the second coating portion when the contaminant collection layer according to the first embodiment is applied to an oven in accordance with one embodiment of the present disclosure, and FIG. 16 is a graph showing the table of FIG. 15. In FIGS. 15 and 16, the first coating portion refers to the inner surfaces of the cooking chamber 20, and the second coating portion refers to the door glass 120. At this time, the first coating portion is coated with a material having at least one of water repellency and oil repellency. The second coating portion is formed with the contaminant collection layer 300 having at least one of a hydrophilic property and a lipophilic property. Specifically, FIGS. 15 and 16 show experimental results obtained mainly in the case in which the first coating portion is coated with a silane compound and the second coating portion is formed with the contaminant collection layer 300 including silicon dioxide ($SiO_2$).

The experimental method will be briefly described below. Chicken was cooked. One chicken was heated in the cooking chamber 20 shown in FIG. 3 at a temperature of 428° F. for 1.5 hours. After the above-described experiment was repeated 10 times, a degree of contamination on the inner surface of the cooking chamber 20 and the door inner surface 101 was measured. The degree of contamination was measured by photographing each of the inner surface of the cooking chamber 20 and the door inner surface 101 and performing image analysis using an image program.

The experimental results are shown in FIGS. 15 and 16. It can be seen in FIGS. 15 and 16 that the larger a surface energy difference was, the larger an amount of contaminants collected in the contaminant collection layer 300 was. Here, the surface energy difference refers to a surface energy difference between the first coating portion and the second coating portion. Since the second coating portion at which the contaminant collection layer 300 was formed had a higher surface energy than the first coating portion, a larger amount of contaminants was adhered to the second coating portion. On the other hand, since the first coating portion coated with a material having at least one of water repellency and oil repellency had a lower surface energy than the second coating portion, a smaller amount of contaminants was adhered to the first coating portion.

Figure 18:
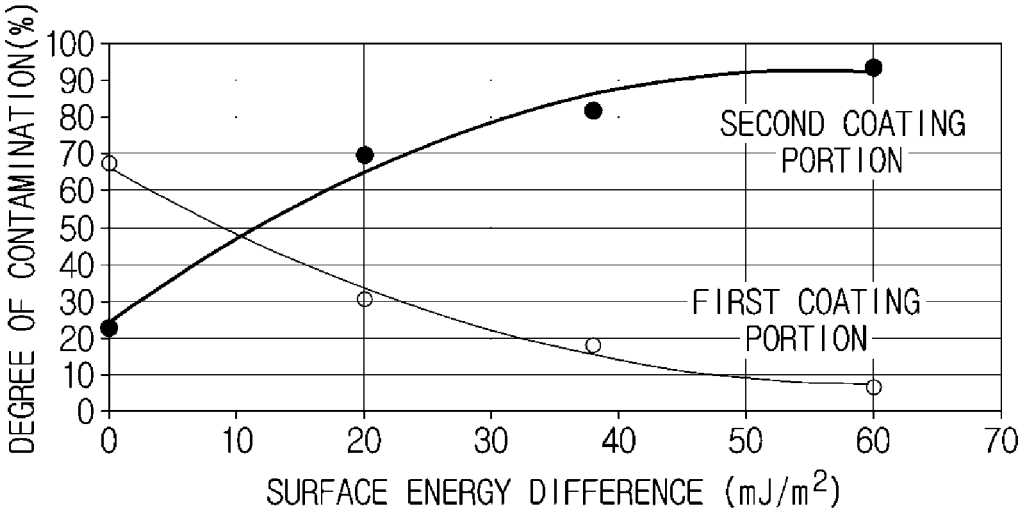
FIG. 18 is a graph showing the table of FIG. 17.

FIG. 17 is a table showing a degree of contamination of each of a first coating portion and a second coating portion according to a surface energy difference between the first coating portion and the second coating portion when the contaminant collection layer according to the second embodiment is applied to an oven in accordance with one embodiment of the present disclosure, and FIG. 18 is a graph showing the table of FIG. 17. In FIGS. 17 and 18, the first coating portion refers to the entire door inner surface 101 and the remaining inner surfaces of the cooking chamber 20 except for the rear surface 23 of the cooking chamber 23, and the second coating portion refers to the rear surface 23 of the cooking chamber 20. At this time, the first coating portion is coated with a material having at least one of water repellency and oil repellency. The second coating portion is formed with the contaminant collection layer 400 having at least one of a hydrophilic property and a lipophilic property. Specifically, FIGS. 17 and 18 show experimental results obtained mainly in the case in which the first coating portion was coated with a silane compound and the second coating portion was formed with the contaminant collection layer 400 including silicon dioxide ($SiO_2$).

The experimental method is the same as that described in FIGS. 15 and 16, and a description thereof will be omitted.

The experimental results are shown in FIGS. 17 and 18. It can be seen in FIGS. 17 and 18 that the larger a surface energy difference was, the larger an amount of contaminants collected in the contaminant collection layer 400 was. A description of the experimental results is also the same as that made in FIGS. 15 and 16 and will omitted.

As should be apparent from the above description, by concentrating contaminants generated during cooking in a portion at which cleaning is easy, it is possible to alleviate a user's cleaning burden.

Also, it is possible to easily remove the contaminants generated during cooking by forming a contaminant collection layer on at least a part of the inner surface of the cooking chamber and the door inner surface.

Also, it is possible to concentrate contaminants in a portion having a higher surface energy by causing a surface energy difference between the inner surface of the cooking chamber and the door inner surface.

Although a few embodiments of the present disclosure have been shown and described, it should be appreciated by those skilled in the art that changes may be made in these embodiments without departing from the principles and spirit of the disclosure, the scope of which is defined in the claims and their equivalents.

What is claimed is:

1. An oven comprising:

a main body;

a cooking chamber provided inside the main body, and having an inner surface and front opening; and a door rotatably installed on the main body to open or close the front opening, wherein the inner surface of the cooking chamber includes:

a contaminant collection layer having at least one of a hydrophilic property and a lipophilic property, formed on a first part of the inner surface of the cooking chamber to collect contaminants on the contaminant collection layer generated during cooking, and at least one of a water repellant material and an oil repellant material coated on a second part of the inner surface of the cooking chamber.

2. The oven according to claim 1, wherein when the contaminant collection layer has the hydrophilic property, the second part of the inner surface of the cooking chamber is coated with the water repellant material, and when the contaminant collection layer has the a lipophilic property, the second part of the inner surface of the cooking chamber is coated with the oil repellant material.

3. The oven according to claim 1, wherein the inner surface of the cooking chamber includes an upper surface, a lower surface, a rear surface, a right side surface, and a left side surface, and the contaminant collection layer is formed on two or more of the upper surface, the lower surface, the rear surface, the right side surface, and the left side surface.

4. The oven according to claim 3, wherein the contaminant collection layer is formed on a plurality of surfaces which face each other among the upper surface, the lower surface, the rear surface, the right side surface, and the left side surface.

5. The oven according to claim 3, wherein the contaminant collection layer is formed on a plurality of connected surfaces among the upper surface, the lower surface, the rear surface, the right side surface, and the left side surface.

6. The oven according to claim 1, wherein the door includes a door inner surface facing the cooking chamber, and the contaminant collection layer is further formed on at least a part of the door inner surface.

7. The oven according to claim 6, wherein the door further includes a door glass and a door frame that supports the door glass, and the contaminant collection layer is formed on at least one of the door glass and the door frame.

8. The oven according to claim 1, wherein the contaminant collection layer includes at least one of a planar heating layer and a catalyst coating layer.

9. The oven according to claim 3, further comprising:

a convection heater provided to heat the cooking chamber;

a convection fan provided to supply heat generated by the convection heater into the cooking chamber during cooking; and a cover case coupled to the rear surface of the cooking chamber to accommodate the convection heater and the convection fan therein, wherein the contaminant collection layer is further formed on the cover case.

10. An oven comprising:

a main body;

a cooking chamber provided inside the main body and having an inner surface and a front opening;

a convection heater provided to heat the cooking chamber;

a convection fan provided to supply heat generated by the convection heater into the cooking chamber; and a cover case having a suction port and a discharge port and coupled to a first surface of the inner surface of the cooking chamber to accommodate the convection heater and the convection fan therein, wherein the inner surface of the cooking chamber further includes:

a contaminant collection layer having at least one of a hydrophilic property and a lipophilic property, formed on a second surface of the inner surface opposing the discharge port to collect contaminants on the contaminant collection layer generated during cooking and at least one of a water repellant material and an oil repellant material coated on a third surface of the inner surface.

11. The oven according to claim 10, wherein the first surface, the second surface, and the third surface include an upper surface, a lower surface, a rear surface, a right side surface, and a left side surface, and the contaminant collection layer is further formed on at least one of the upper surface, the lower surface, the rear surface, the right side surface, and the left side surface, which is connected to second surface.

12. The oven according to claim 10, wherein the first surface, the second surface, and the third surface include an upper surface, a lower surface, a rear surface, a right side surface, and a left side surface, and the contaminant collection layer is further formed on one of the upper surface, the lower surface, the rear surface, the right side surface, and the left side surface, which faces the second surface.

13. The oven according to claim 10, wherein the contaminant collection layer is further formed on the cover case.

14. The oven according to claim 10, further comprising:

a door rotatably installed on the main body to open or close the front opening of the cooking chamber and having a door inner surface facing the cooking chamber, wherein the contaminant collection layer is further formed on at least a part of the door inner surface.

15. The oven according to claim 10, wherein when the contaminant collection layer has the hydrophilic property, the third surface of the cooking chamber is coated with the water repellant material, and when the contaminant collection layer has the lipophilic property, the third surface of the cooking chamber is coated with the oil repellant material.

16. An oven comprising:

a main body;

a cooking chamber provided inside the main body, and having an inner surface and an front opening;

a door rotatably installed on the main body to open or close the front opening of the cooking chamber and having a door inner surface facing the cooking chamber;

a plurality of air flow passages formed along the inner surface of the cooking chamber and the door inner surface such that air circulating inside the cooking chamber flows through the plurality of air flow passages;

a contaminant collection layer, having at least one of a hydrophilic property and a lipophilic property, formed on one of the plurality of air flow passages to collect contaminants on the contaminant collection layer generated during cooking; and at least one of a water repellant material and an oil repellant material coated on an other one of the plurality of air flow passages.

17. The oven according to claim 16, wherein the plurality of air flow passages include a first air flow passage and a second air flow passage, which are symmetrical with each other, and the contaminant collection layer is formed on any one of the first air flow passage and the second air flow passage.

18. The oven according to claim 17, wherein the plurality of air flow passages further include a door adjacent portion adjacent to the door, and the contaminant collection layer is formed on the door adjacent portion of either the first air flow passage or the second air flow passage.

19. The oven according to claim 16, wherein when the contaminant collection layer has hydrophilic property, the other one of the plurality of air flow passages is coated with the water repellant material, and when the contaminant collection layer has the lipophilic property, the other one of the plurality of air flow passages is coated with the oil repellant material.

20. The oven according to claim 16, wherein the contaminant collection layer includes at least one of a planar heating layer and a catalyst coating layer.

* * * * *